US006688073B2

(12) United States Patent
VanderWerf et al.

(10) Patent No.: US 6,688,073 B2
(45) Date of Patent: Feb. 10, 2004

(54) METHOD OF FORMING A COMPOSITE PANEL

(75) Inventors: Pieter Anthony VanderWerf, Stoughton, MA (US); Ivan J. Becica, Cherry Hill, NJ (US); John Poignard, Pilesgrove, NJ (US); J. C. Henry, III, Clayton, NJ (US); Jirair Youssefian, Haddon Heights, NJ (US)

(73) Assignee: Chameleon Cast Wall System LLC, Brookline, MA (US)

( * ) Notice: Subject to any disclaimer, the term of this patent is extended or adjusted under 35 U.S.C. 154(b) by 0 days.

(21) Appl. No.: 10/059,820

(22) Filed: Jan. 29, 2002

(65) Prior Publication Data

US 2002/0129578 A1 Sep. 19, 2002

Related U.S. Application Data

(63) Continuation-in-part of application No. 09/772,633, filed on Jan. 30, 2001.

(51) Int. Cl.[7] ..... E04B 1/00

(52) U.S. Cl. ..... 52/745.09; 52/745.11; 52/742.14; 52/284; 52/408; 52/411; 52/413; 52/782.1; 52/783.1; 52/309.1; 52/309.12; 52/309.3; 52/749.14; 52/749.13; 52/DIG. 2; 249/15; 249/16; 249/91; 249/96; 249/112; 249/189; 264/35; 264/225; 264/226; 264/257; 264/261; 264/264; 264/277; 264/278; 264/601; 264/602

(58) Field of Search ..... 52/742.14, 745.09, 52/745.11, 284, 782.1, 796.1, 408, 413, 411, 783.1, 309.12, 309.3, 749.14, 749.13, DIG. 2; 54/596; 249/96, 91, 15, 16, 112, 189; 264/35, 225, 226, 257, 261, 264, 277, 278, 601, 602

(56) References Cited

U.S. PATENT DOCUMENTS

| | | | | | |
|---|---|---|---|---|---|
| 3,619,441 | A | * | 11/1971 | Burchett | 264/71 |
| 3,619,457 | A | * | 11/1971 | Chandler et al. | 264/256 |
| 3,621,086 | A | * | 11/1971 | Gulde | 264/71 |
| 4,115,501 | A | * | 9/1978 | Yano | 264/133 |
| 4,132,043 | A | * | 1/1979 | Juba | 52/309.17 |
| 4,167,549 | A | * | 9/1979 | Creskoff | 264/42 |
| 4,331,628 | A | * | 5/1982 | Ziegler | 264/553 |
| 4,346,050 | A | * | 8/1982 | Trent et al. | 264/71 |
| 4,842,241 | A | * | 6/1989 | Fitzgerald et al. | 249/50 |
| 5,074,517 | A | * | 12/1991 | Scott | 249/112 |
| 5,730,797 | A | * | 3/1998 | Parrish et al. | 106/716 |

* cited by examiner

*Primary Examiner*—Carl D. Friedman
*Assistant Examiner*—Christy Green
(74) *Attorney, Agent, or Firm*—Theodore R. Paulding

(57) ABSTRACT

A method of forming a composite panel with a facade comprising a planar arrangement of thin discrete facers on a body of structural backing material. The method comprises the steps of providing a horizontal casting bed, providing a plurality of facers each with chamfers at corners between side-rear and end-rear walls, arranging the facers in abutting relationship atop the casting bed and in a selected pattern in a face down planar configuration so that the chamfers on the facers open upwardly and define narrow elongated sealant channels at joints between contiguous facers. Depositing a sealant in the channels and pouring concrete as a structural backing material atop the facers, the rear surfaces of the facers and the concrete adhering to form a composite panel.

50 Claims, 20 Drawing Sheets

METHOD OF FORMING A COMPOSITE PANEL

CROSS REFERENCE TO RELATED APPLICATION

This application is a Continuation in Part and claims the benefit of U.S. patent application Ser. No. 09/772,633, filed Jan. 30, 2001, the disclosure of which is herein incorporated by reference.

FIELD OF THE INVENTION

This invention is directed to a method of forming a composite panel with a facade comprising a planar arrangement of thin discrete facers on a body of a structural backing material.

BACKGROUND OF THE INVENTION

Composite concrete and other panels have been in use for a number of years but have not been entirely satisfactory. A bare concrete panel, for example, may be found lacking aesthetically or in other characteristics such as resistance to certain chemicals, durability, excessive heat gain from the sun, dirt or grime resistance, etc. Accordingly, a number of methods have been proposed to finish the front surfaces of panels in order to improve their aesthetic and architectural appearance and other properties.

For example, a number of different methods have been tried to cast in place or otherwise adhere discrete facing units or "facers" on the front surfaces of panels in finished concrete structures. As is well known, different methods have been employed in holding individual facers in a desired pattern, usually in a common horizontal plane, while concrete is cast over and about their rear surfaces so as to at least partially embed them in a wall or other panel. Facers such as thin concrete units manufactured on masonry block machines may be employed in accordance with the present invention together with bricks, tiles, natural stone, concrete pavers, etc. to provide a visually pleasing appearance or to meet functional requirements.

In manufacturing composite walls, in particular, it has been a conventional practice to provide various types of forms, grids etc. in securing the facers in face-down position prior to casting concrete or other structural material thereover. However, such methods have not been wholly satisfactory. For example, downward leakage of concrete between facers may result in concrete adhering to the front faces of the latter and in substantial added expense in subsequent removal thereof. Such prior methods have also failed to achieve economic advantage due to complicated and tedious manual steps involved in assembling and removing forms, grids, etc. Obviously, grouting between facers is also required in some designs when the panel is complete.

It is a general object of the present invention to provide a simplified method for making high quality composite walls and other panels at economic advantage, which yet results in a clean aesthetically pleasing final appearance and/or improved functional surface of the facer surfaced wall or other panel.

A further object of the invention resides in a method of making a composite panel which obviates the need for grouting between facers mounted on the panel.

A still further object is to provide a simplified method which requires an absolute minimum manpower requirement and yet results in panels pleasing in appearance and/or improved functional characteristics and a high degree of structural integrity.

SUMMARY OF INVENTION

In fulfillment of the foregoing objects and in accordance with the present invention, a method of forming a composite wall or other panel with a planar arrangement of thin discrete facers on a sturdy structural backing material comprises the steps of providing a flat preferably horizontal casting bed which may be of either a rigid or slightly deformable material. The ability of a casting bed to deform slightly allows the arrangement of facers accurately in a common plane despite irregularities which may occur on their front surfaces. Plastic foam or other similar materials may be employed in forming such a casting bed as well as a fine particulate material such as sand. When facers with smooth flat surfaces lacking any significant irregularities are employed, a rigid or hard surface casting bed may of course be employed preferably with a heavy paper, plastic sheet or very thin plastic foam thereover.

A plurality of facers each with a chamfer, bevel, or other recess along at least a major portion of the edges or corners between its side walls, end walls and rear wall are provided and arranged with the facers on the casting bed in abutting relationship face down. Various geometric patterns may be employed but the facers are in all cases positioned in a face down attitude and in a common plane, so that the aforesaid chamfers or other recesses are adjacent each other and open rearwardly or upwardly to define narrow elongated channels at joints between contiguous facers. Certain of the channels with two adjacent opposing chamfers may take "V" configurations in cross-section while others with only one chamfer may take one half (½) "V" configurations in cross-section.

In addition to the foregoing, sealant may be placed in the elongated recesses or channels and may also take a variety of forms. For example, elongated unitary sealing members, hardenable liquids, or fine particulate materials such as sand may be used, the latter being presently preferred. A castable structural backing material such as concrete or other cementitious material is then placed or poured rearwardly of the facers and both conforms to and adheres to the rear surfaces thereof as it cures and hardens. A composite wall or other panel is thus formed and may thereafter be moved to its operative position. For example, if the panel takes the form of a tilt-up wall poured horizontally, a simple upward swinging movement through 90° may be effected from its horizontal casting bed.

Channels provided adjacent joints may be filled with sand, for example, prior to casting concrete thereover and the sand may later be washed or blown out of the channels to provide drainage channels to prevent water accumulation behind the facers.

Generally, the facers have a rectangular configuration and the rear corners thereof are beveled or chamfered at edges or corners between each end wall and rear wall and at least one side wall and rear wall. Chamfers or other recesses may take various configurations viewed in cross-section including rectangular and arcuate, but a flat angularly inclined surface extending between adjacent right angularly related side or end and rear facer surfaces is preferred. When a sealant such as sand is employed, a subsidiary method step may take the form of depositing sand on the rear surfaces of the facers and sweeping the same into the sealant channels with the remainder of the facer rear surfaces being cleaned for good adhesion of the concrete.

Preferably, the rear surfaces of the facers are also provided with integral rearwardly and upwardly projecting structural connecting means which are enveloped during the pouring of concrete and thereafter firmly embedded in the cured concrete for enhanced structural integrity of the wall or other panel. Such walls or other panels are found to be substantially stronger than walls or panels without facers and may even approach the strength of monolithic concrete walls or panels of equal overall thickness. The connecting means presently take the preferred form of a series of spaced apart rearwardly projecting parallel ribs integral with the bodies of the facers. Further, the ribs are preferably formed as shown in the drawings with dove-tail configurations in cross-section defining complementary generally dove-tail grooves therebetween.

Still further in accordance with the preferred form of the invention, a plurality of spring clips are provided to interconnect the aforementioned ribs. Some of the clips may be installed in interconnecting relationship on aligned ribs of contiguous facers arranged in end-to-end relationship and others on contiguous half ribs arranged in side-by-side relationship on adjacent facers in like relationship. The clips are preferably of generally dove-tail configuration viewed in cross-section with short opposing side legs defining entry openings for the dove-tailed ribs. Further, the legs of each clip are inwardly inclined toward the mouth of the clip opening so that the clips may be snapped into firm embracing engagement on the ribs in relative movement toward the ribs. Thereafter the clips serve to urge facers and especially the side-by-side facers firmly together in abutting engagement to prevent concrete leakage downwardly therebetween.

Further, the clips also help to maintain the facers in a common plane preventing accidental or unintended displacement of individual facers. Still further, the clips aid in urging facers having uneven front surfaces and facers improperly positioned toward a common plane.

A tool of appropriate design may also be provided for ease of convenience in the assembly of the clips on the ribs.

Finally, a plurality of upstanding anchors may be provided with base portions mounted on the ribs of the facers and supports for horizontal reinforcing members such as "re-bars" may also be provided with the latter also mounted on rear surfaces of the facers in engagement with ribs and inter-rib grooves.

DETAILED DESCRIPTION OF THE INVENTION

Figure 2:
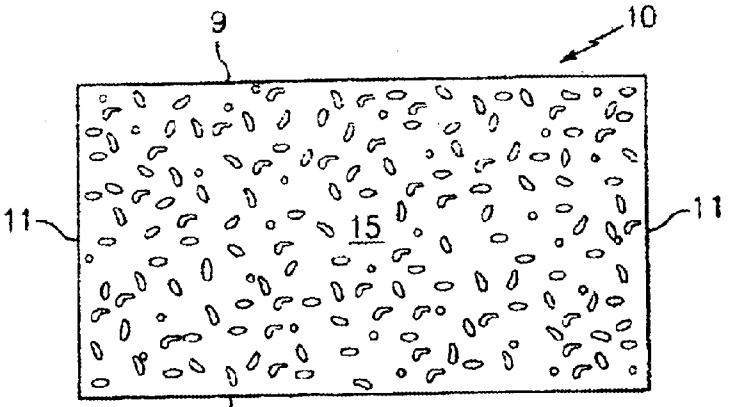
FIG. 2 is a front view of the facer of FIG. 1.
Figure 4:
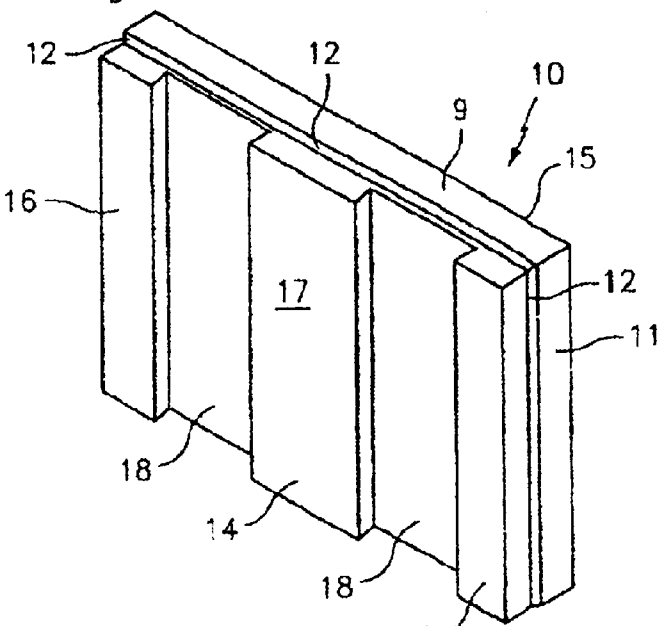
FIG. 4 is a perspective view of the rear surface of the facer.
Figure 3:
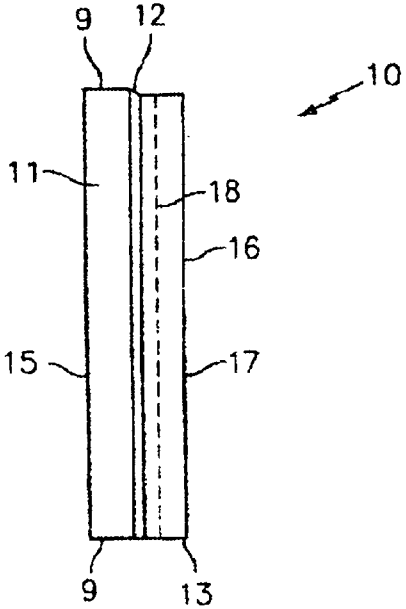
FIG. 3 is a view taken from the end of the facer.

Referring now particularly to FIGS. 1–4, a facing unit or "facer" is illustrated generally therein at 10 in a presently preferred form. As mentioned above, facers may take a wide variety of forms including thin concrete units capable of formation in masonry block machines, conventional bricks, concrete pavers, natural stone etc. The facer 10 shown is of the concrete type formed in a masonry block machine and has a decorative face or front wall 15 of pleasing appearance as best illustrated in FIG. 2. The facer also has at least one recess and preferably two recesses in the form of beveled or chamferred edges or corners 12, 12 between the end walls 11,11 and rear wall 17 and along one side wall 9 and rear wall 17 edge or corner. The opposite rear wall side wall edge or corner 13 is devoid of a bevel or chamfer as best illustrated in FIGS. 3 and 4, this due to the inability of block machines to conveniently form chamfers on all four rear corners of the facers.

Figure 1:
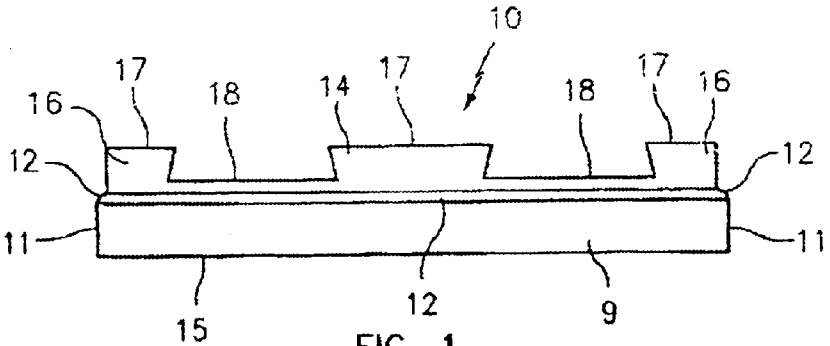
FIG. 1 is a side view of a "facer" constructed in accordance with the present invention.

Connecting means for co-operation with concrete or other structural backing material on the rear surface of the facer preferably take the form of integral dove-tail ribs as shown. A single centrally located full rib 14 is shown in FIG. 1 and partial, approximate parallel half ribs 16, 16, are also shown in FIG. 1 on opposite sides of the rib 14. Dove-tail grooves 18, 18 are defined between ribs as best illustrated in FIGS. 1 and 4.

Figure 5:
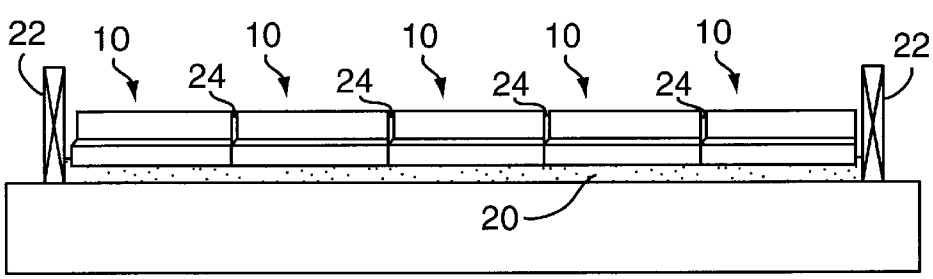
FIG. 5 is a side view of a partially constructed wall with facers disposed atop a casting bed of sand in abutting relationship and with one-half (½) "Y" sealant channels between facers.
Figure 6:
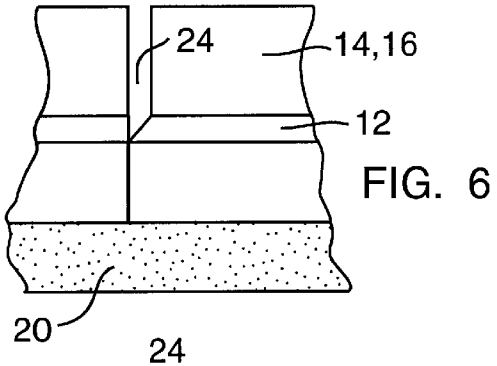
FIG. 6 is a fragmentary enlarged view of a facer joint taken from FIG. 5.

Referring now to FIGS. 5 through 10, the method of the invention will be illustrated and described sequentially. In FIG. 5 a plurality of facers 10, 10 are shown positioned in abutting face down relationship and in a common plane atop casting bed 20. The casting bed 20 may be rigid or deformable as mentioned. Foam plastic and other materials may be employed in a deformable bed but fine particulate material, such as sand is shown in FIGS. 5 through 10. Form members 22, 22 establish the marginal limits of the casting bed. Channels defined between facers are at least one-half (½) "Y" configurations viewed in cross-section and may accommodate sealant as mentioned. As best illustrated in FIG. 6 a chamfer 12 on a right hand facer forms a one-half (½) "Y" channel with the straight face of a left hand facer adjacent thereto.

Figure 7:
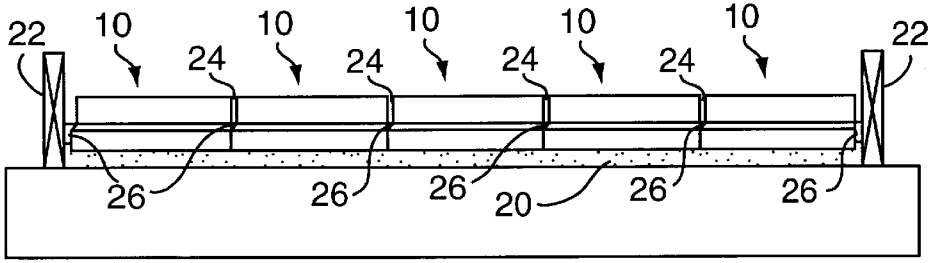
FIG. 7 is a view similar to FIG. 5 but with sand disposed in the sealant channels.
Figure 8:
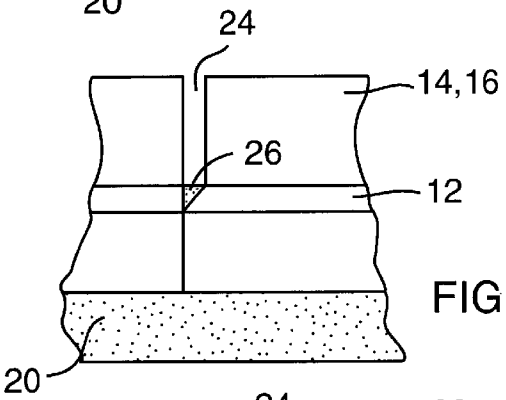
FIG. 8 is a fragmentary enlarged view of an inter-facer joint as in FIG. 6 but with sand deposited in the sealing channel.

In FIGS. 7 and 8, a sealant has been introduced to the channels 24 and may comprise a fine particulate material, preferably sand 26 as mentioned above. This may be conveniently accomplished by depositing sand atop the backs of the facers, sweeping the same into the sealant channels 24, 24 and concurrently sweeping the sand away to clean the backs of the facers for good adherence to the concrete.

Figure 9:
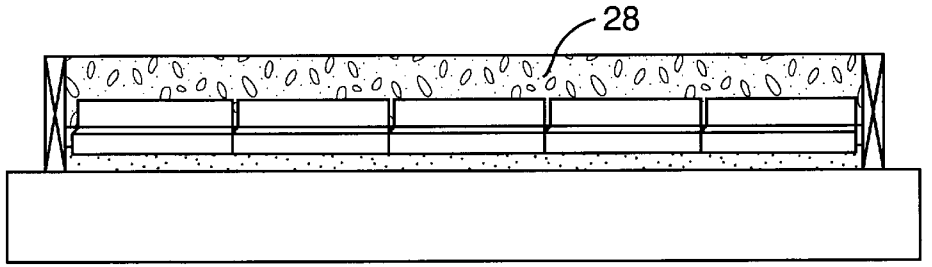
FIG. 9 is a side view similar to FIGS. 5 and 7 but with concrete deposited atop the facers.
Figure 10:
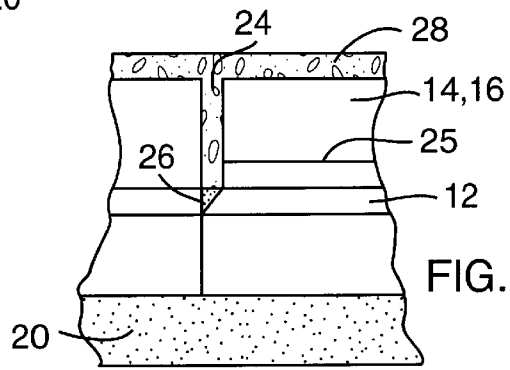
FIG. 10 is a fragmentary enlarged view of a facer joint as illustrated in FIG. 9.

FIGS. 9 and 10 illustrate the facers 10, 10 with a cementitious structural member cast thereabove, conforming to and adhering thereto. Concrete is preferably employed as mentioned but various other materials capable of being cast in situ may also be used. As best illustrated in FIG. 10, the concrete is formed about the ribs 14, 16 and at the joints there between. Downward penetration of the concrete between facers during pouring and curing is prevented by the sand 26 which forms a seal between the facers as stated.

Figure 11:
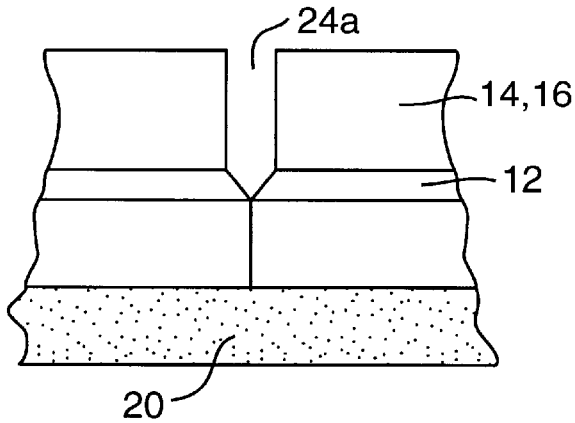
FIG. 11 is enlarged fragmentary view of a facer joint as in FIG. 6 but with an Y-shaped sealant channel.
Figure 12:
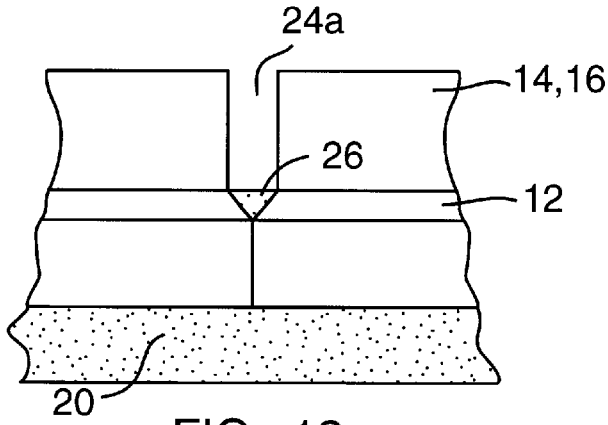
FIG. 12 is similar to FIG. 11 but with sand deposited in the channel as a sealant.
Figure 13:
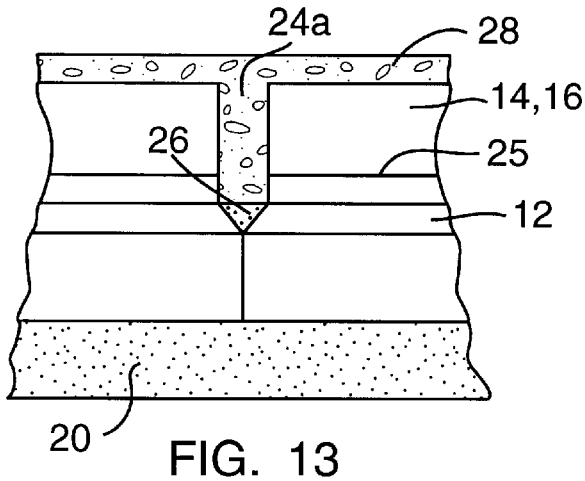
FIG. 13 is a view similar to FIGS. 11 and 12 but with structural material deposited atop the facers.

In FIGS. 11–13, joints 24*a*, 24*a* are shown between facers 10, 10. The "Y" shaped sealant channels shown obviously result where adjacent facers are provided with identical but opposing chamfers 12, 12. The method employed is identical with that of FIGS. 5 through 10. That is, sand is introduced to the channels as shown at 26 in FIGS. 12 and 13. The excess sand may then be swept clean and the concrete or other cementitious material 28 poured and allowed to cure and harden as shown in FIG. 13, the sand 26 serving its sealing function in each of the channels as stated. Thus, concrete is prevented from penetrating downwardly and defacing the front surfaces of the pavers.

Figure 42:
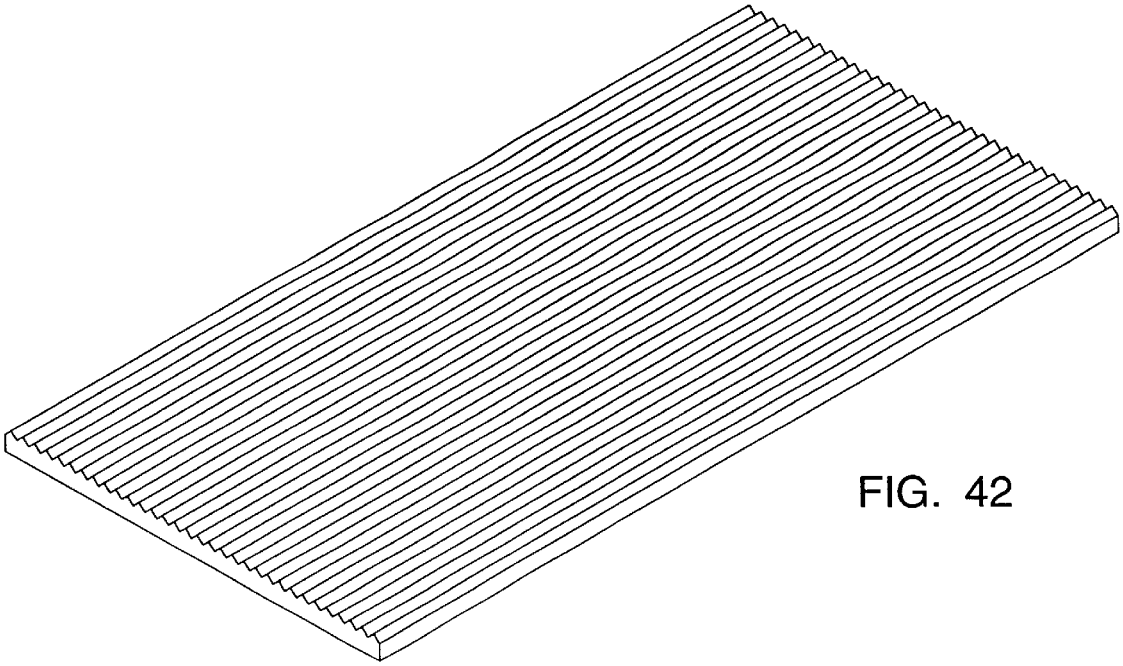
FIG. 42 is a foam plastic mat in a corrugated configuration for use as a casting bed.
Figure 43:
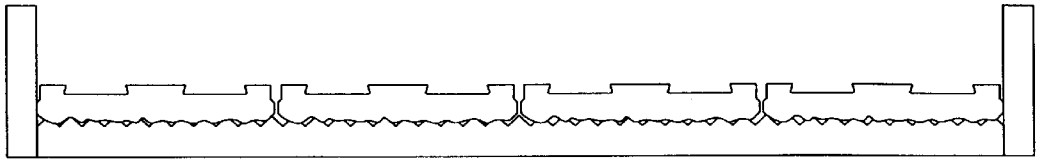
FIG. 43 shows the mat of FIG. 42 with facers placed thereon in abutting relationship.

As a substitute for sand, a casting bed with a degree of deformability can also be provided with foam plastic as illustrated in FIGS. 42 and 43. Expanded polystyrene is presently a preferred material and may be advantageously employed in a corrugated form as shown in FIG. 42. Facers are placed on the plastic bed in an inverted attitude and in abutting relationship as with the sand bed above and as shown in FIG. 43. Excellent results have also been achieved with this alternative.

Figure 14:
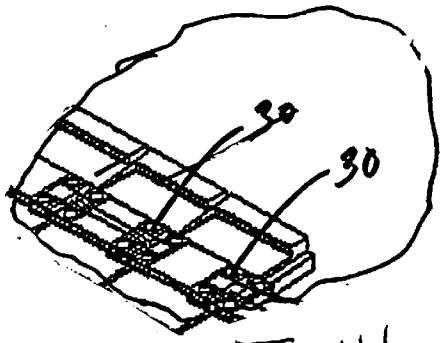
FIG. 14 is a perspective view of a plurality of facers positioned in face down abutting relationship and partially forming the front section of a panel, spring clips being mounted on ribs which project upwardly from the facers.

In FIG. 14, a plurality of facers 10, 10 are shown in a partially complete panel in association with optional spring clips 30, 30. The spring clips 30, 30 each have a dove-tail configuration complementary to the cross-section of the ribs 14, 16. That is, a single central rib 14 can be interconnected with clips to a second rib 14 in end-to-end relationship as shown. Further, end ribs 16, 16 in side-by-side relationship can also be readily interconnected by clips 30, 30 as shown. The clips may be entered about a single rib 14 or a pair of adjacent end ribs 16, 16 in relative endwise movement and positioned as desired to serve their interconnecting function.

Preferably, however, the clips are urged downwardly over and into engagement with the ribs with opposite legs 32, 32 first being spread apart and then contracting in a snap action to firmly embrace the ribs.

Figure 15:
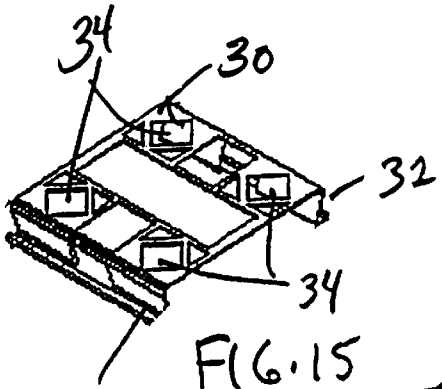
FIG. 15 is an enlarged perspective view showing an individual spring clip.
Figure 17:
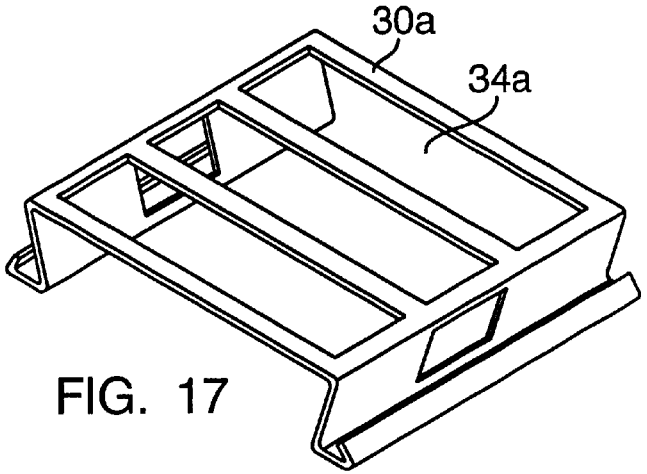
FIG. 17 is a perspective view of the spring clip of FIG. 16.
Figure 18:
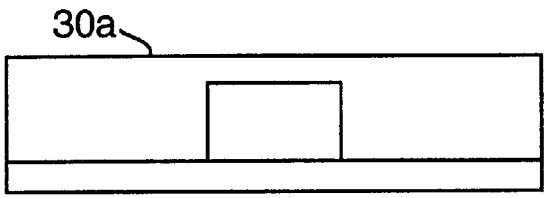
FIG. 18 is a side view of the spring dip of FIGS. 16, 17.
Figure 16:
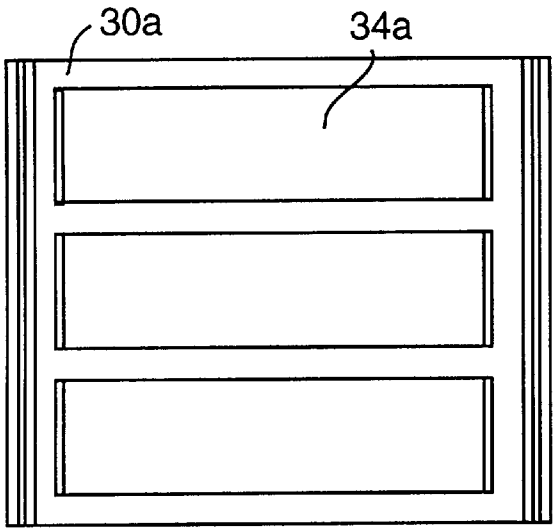
FIG. 16 is a top view of an alternative dip.
Figure 21:
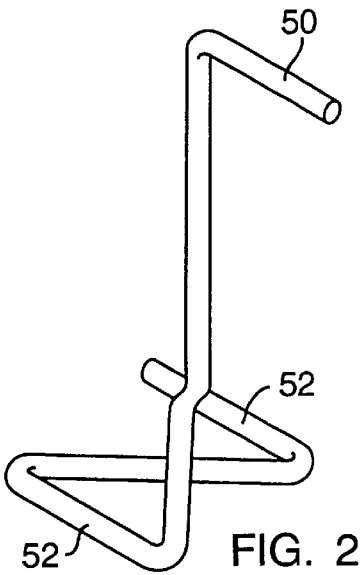
FIG. 21 is a perspective view of the anchor of FIGS. 19 and 20.
Figure 22:
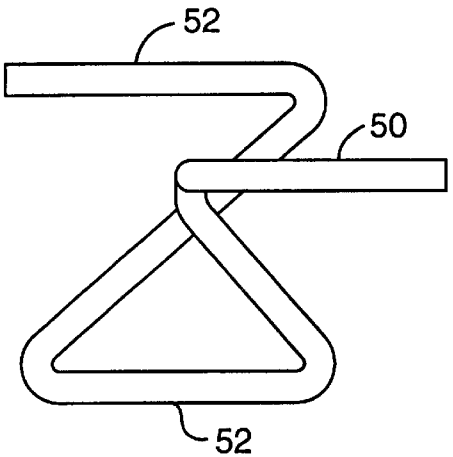
FIG. 22 is a top view of the anchor.
Figure 20:
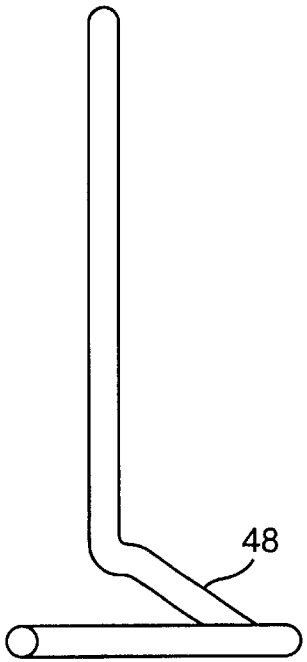
FIG. 20 is an opposite side view of the anchor of FIG. 19.
Figure 19:
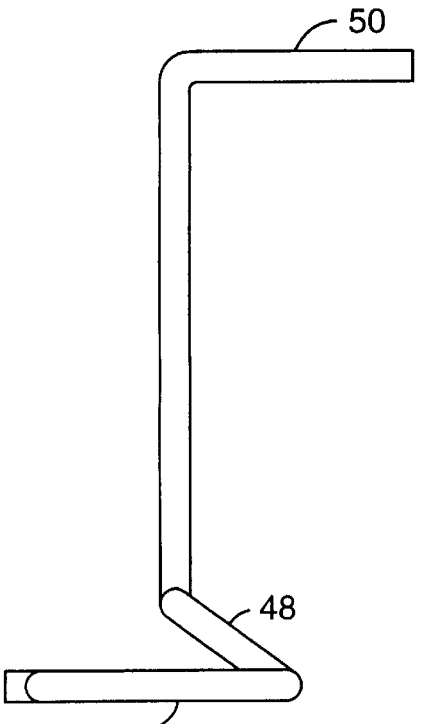
FIG. 19 is a side view of an anchor adapted to be mounted on a back surface of a facer.
Figure 24:
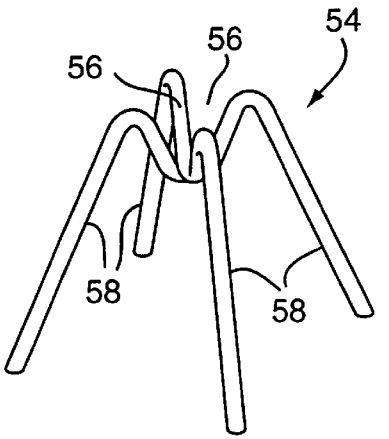
FIG. 24 is a perspective view of the re-bar chair of FIG. 23.
Figure 26:
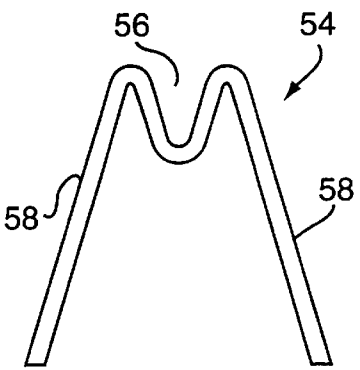
FIG. 26 is another side view better showing an upwardly open groove for receiving and supporting a re-bar.
Figure 23:
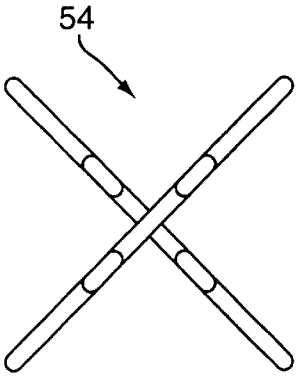
FIG. 23 is a top view of a "chair" for supporting elongated concrete reinforcing members or "re-bars".
Figure 25:
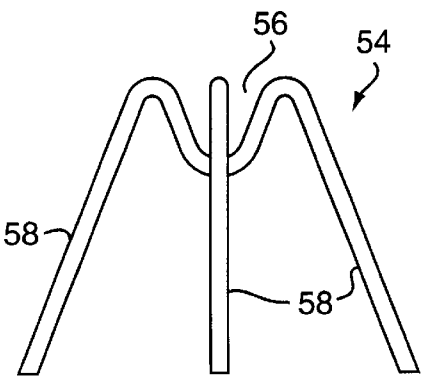
FIG. 25 is a side view of the chair.
Figures 30, 31, 32, 33:
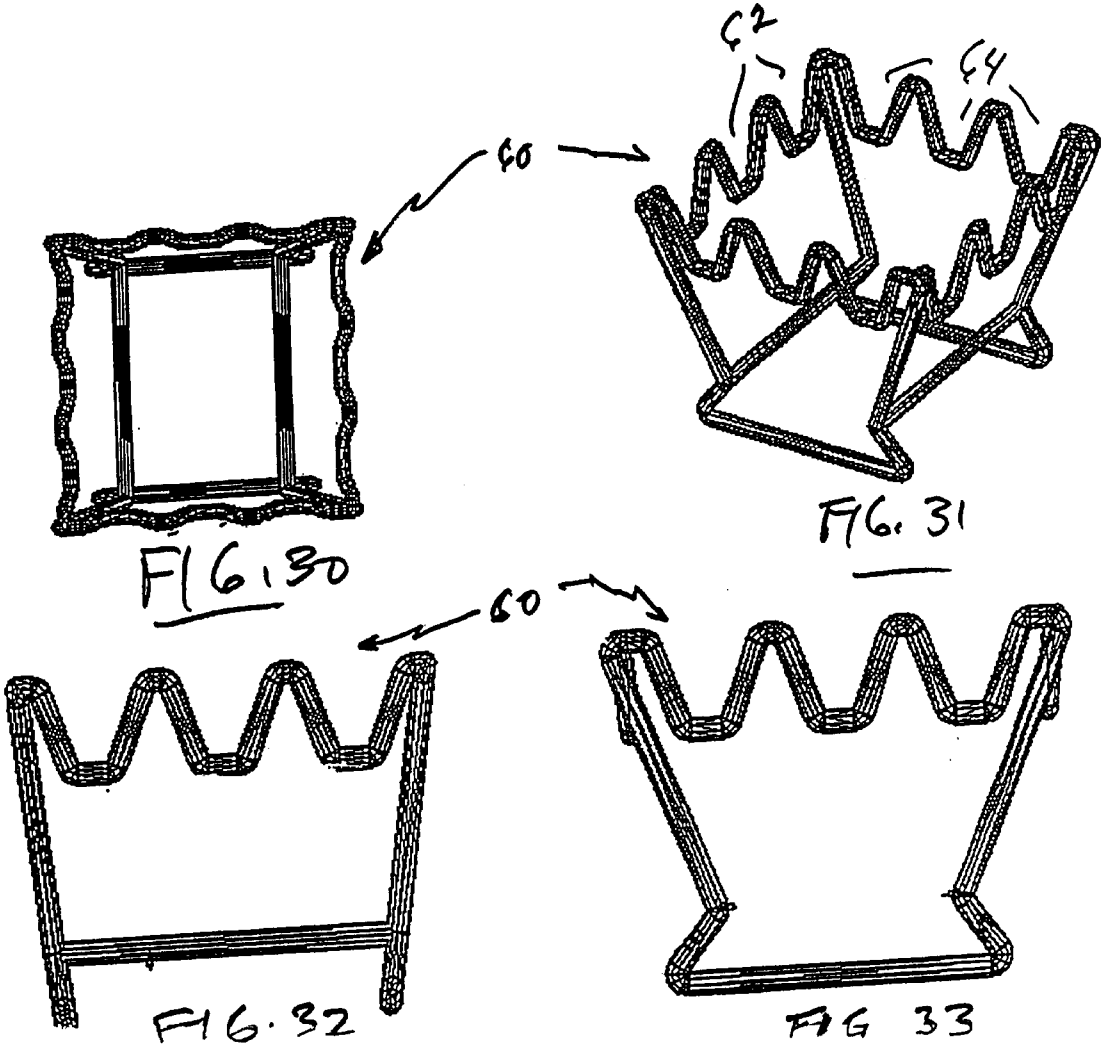
FIG. 30 is a top view of a chair having three mounting grooves arranged in alignment with three opposite grooves; thus, three re-bars being accommodated in right angular arrangement with three additional re-bars.
FIG. 31 is a perspective view of the re-bar chair of FIG. 30.
FIG. 32 is a first side view of the re-bar chair of FIGS. 30 and 31.
FIG. 33 is a second and opposite side view of the chair.
Figure 35:
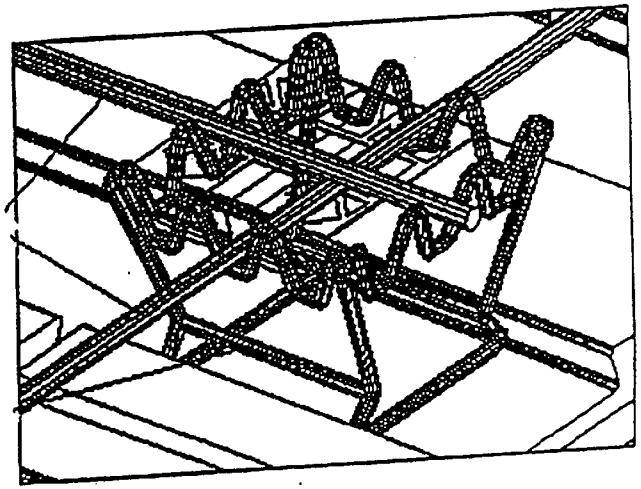
FIG. 35 is a perspective view similar to FIG. 34 but with a base portion of the chair entered in and engaging the opposite side-walls of an inter-rib groove.
Figure 34:
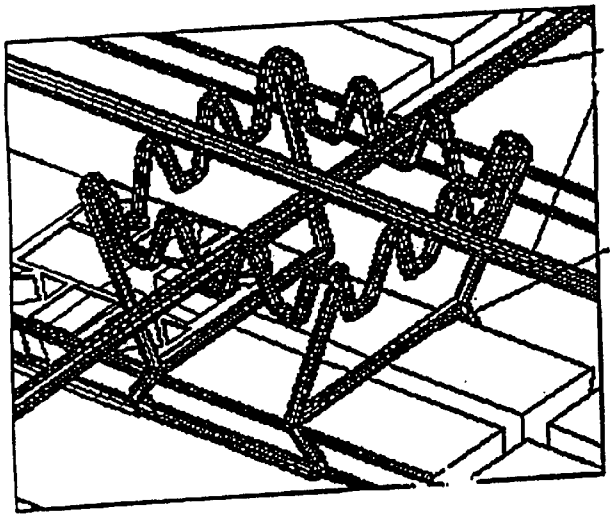
FIG. 34 is a perspective view of the chair of FIGS. 30–33 with a single re-bar mounted thereon in each right angular direction and with the base portion of the chair mounted in embracing relationship on ribs on the back of a facer.

FIGS. 16–18 illustrate a second embodiment of the clips at 30*a* and it will be observed that each of the clips includes openings as at 34 in FIGS. 14, 15 and 34*a* in FIGS. 16–18. The openings 34 and 34*a* allow concrete to penetrate downwardly and adhere to the aforementioned ribs 14, 16 during pouring and subsequent curing.

Figure 39:
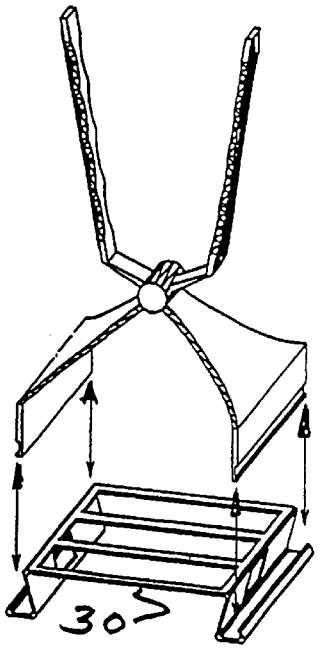
FIG. 39 is a perspective view illustrating operation of the tool in respect to a spring clip.
Figure 38:
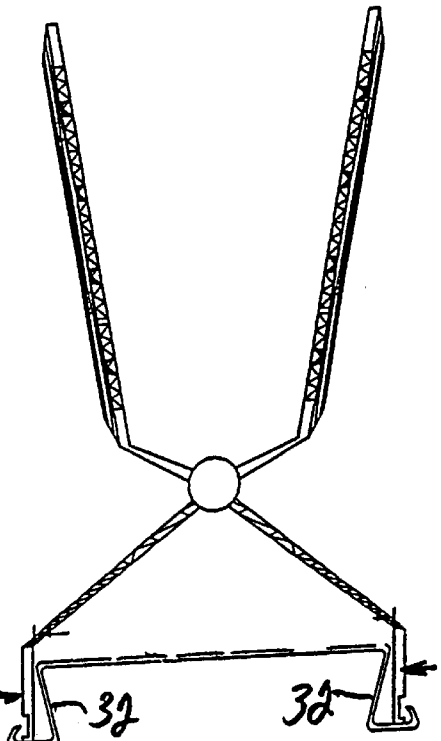
FIG. 38 is a similar view of the same tool with the clip in a contracted position.
Figure 37:
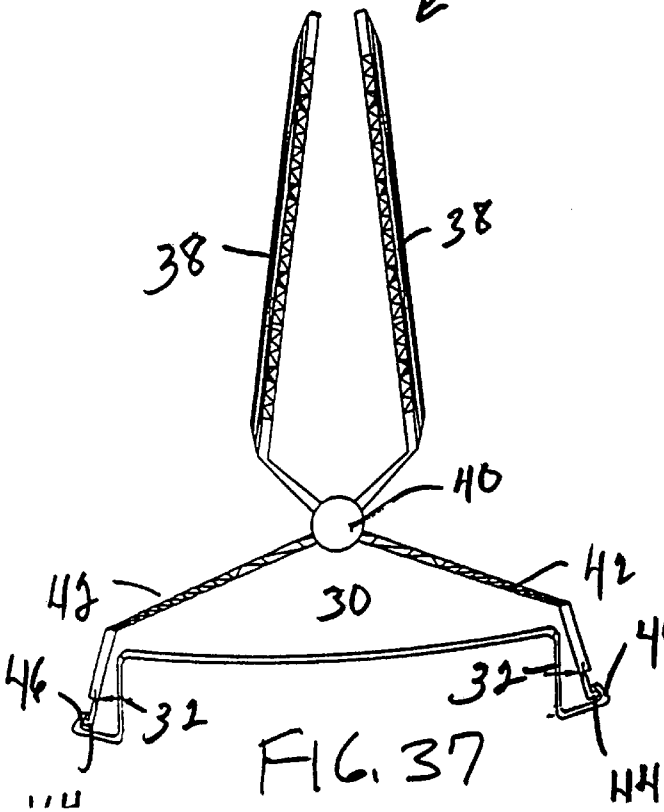
FIG. 37 is a side view of a tool for installing spring clips with an associated clip shown in an expanded condition.

The installation of the clips may be accomplished manually as mentioned or with the aid of a tool 36 illustrated in FIGS. 37–40. The tool 36 has manually operable handles 38, 38 pivotally connected at 40 and opposed operating arms 42, 42 each with a small outwardly directed lip 44. The lips 44, 44 engage small inwardly extending hook-like members 46, 46 at the ends of the legs of a clip 30 to spread the legs 32, 32 of the clips for easy positioning of the same about a rib. Once a clip has been positioned about the rib the tool may be released to allow the legs to spring inwardly and snap into firm embracing relationship with one or more ribs. FIG. 38 shows the release of the clip and the vertical movement of the tool is illustrated in FIG. 39. Once the clips have been installed as shown in FIG. 14, pouring of the concrete may be initiated as described above.

The clips 30, 30*a* may be employed to ensure firm abutting engagement of the facers in the embodiment described above with a sealant disposed in the recesses or channels at facer joints. Further, satisfactory results may be achieved with the clips in some cases even without sealant disposed in the channels between facers. That is, the forces provided by the clips urging the facers into engagement may result in joints between facers which are sufficiently tight to prevent penetration of the concrete through the joints and a resulting undesirable flow of small quantities of concrete onto front surfaces of the facers. These conditions may prevail when facers with particularly smooth surfaces are employed. Further, it may be possible to eliminate both the sealant and the clips in certain situations. Here again, manually abutting facers with exceptionally smooth side surfaces may result in joints sufficiently tight to prevent downward concrete penetration.

A product known as Self Compacting Concrete not requiring vibration may also be employed to advantage as a structural backing material particularly in this latter embodiment of the method. In the absence of vibration, which is required with conventional concrete for uniformity and for filling small voids, there is considerably less likelihood of penetration or leakage through the facer joints.

In addition to the foregoing, "anti bonding agents" and "retarders" may be applied to the front surfaces of the facers. This facilitates or may completely eliminate cleaning of the facers as a final step in the process of making the walls or other panels of the present invention.

Figure 36:
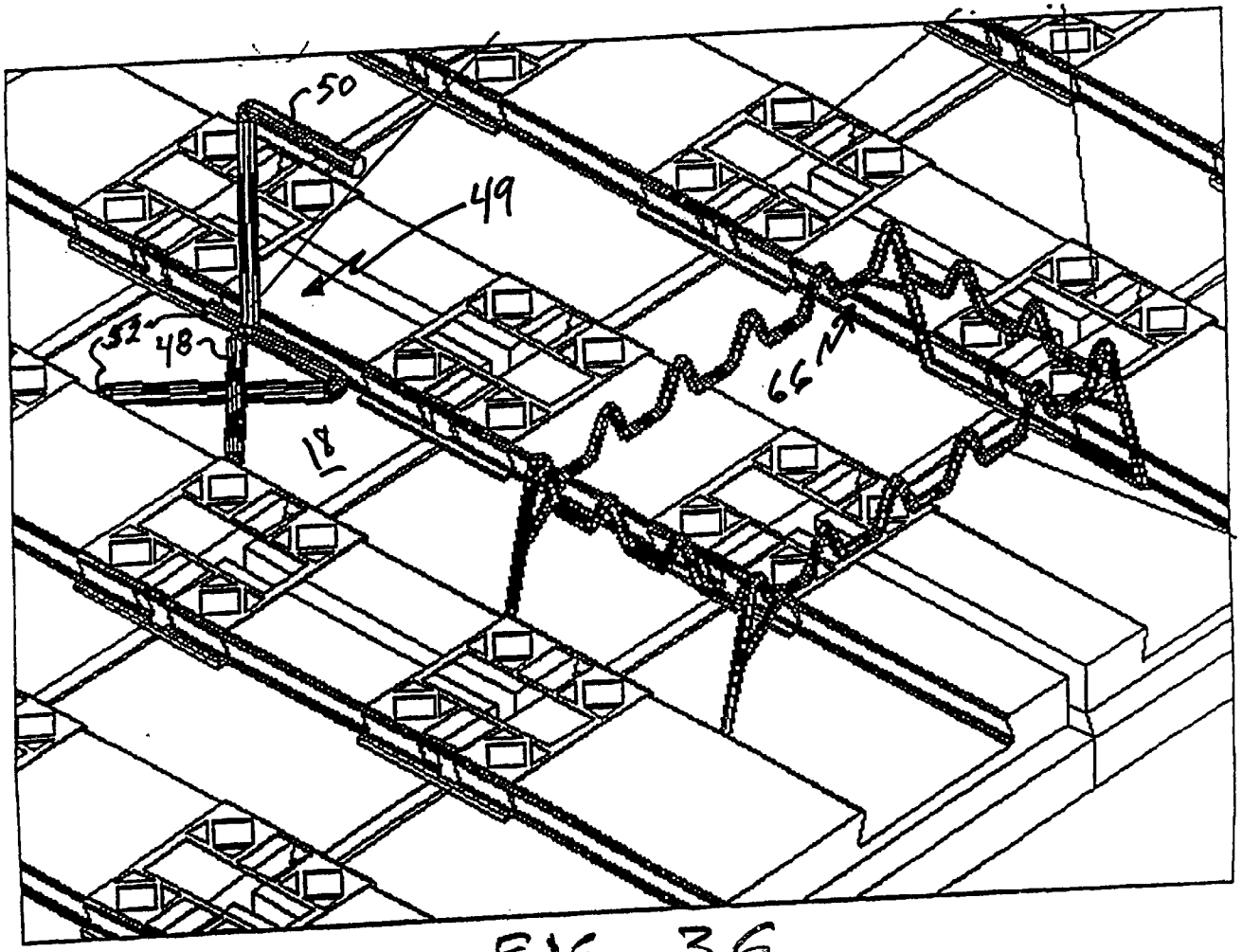
FIG. 36 is a perspective view showing a number of facers with an anchor and a large chair having three aligned grooves in one direction and five aligned grooves in right angular arrangement therewith.
Figure 40:
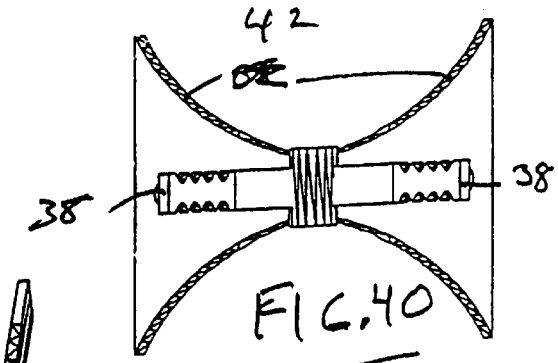
FIG. 40 is a top view of the tool of FIGS. 37–39.

In certain applications, additional strength may be required in connecting the facers to the structural backing material of the panel. FIGS. 19–22 illustrate an anchor 49 employed for this purpose. In FIG. 36 the anchor 49 is shown in operative position mounted on a facer prior to the casting of concrete thereabout. The anchor has a base portion 48 adapted to enter and fit a groove 18 as illustrated in FIG. 36. An upwardly projecting portion is adapted to be embedded in the concrete and thereby provide enhanced strength securely interconnecting the facers and their structural backing. As shown, the base portion 48 takes a generally Z shape with opposing legs 52, 52 adapted to enter a groove 18 and firmly engage the opposing ribs which define the groove. The upper portion of the anchor includes an integral arm 50 which extends horizontally with the anchor mounted on the facers and which is embedded in the concrete as mentioned.

Figure 28:
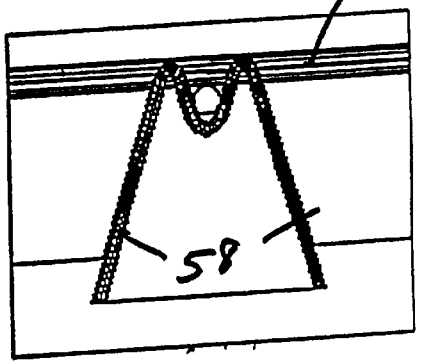
FIG. 28 is a side view showing the chair supporting right angularly arranged re-bars.
Figure 27:
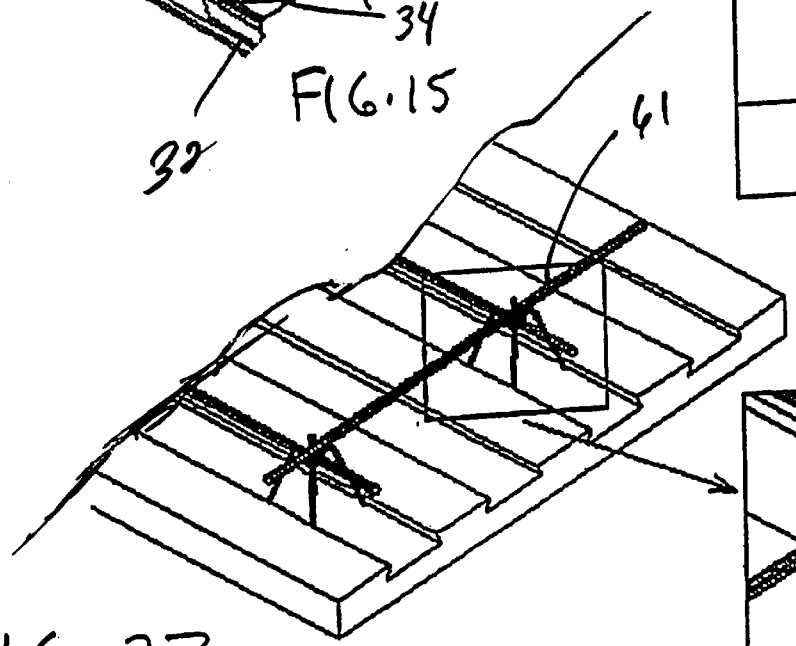
FIG. 27 is a perspective view showing a number of facers with chairs mounted thereon as in FIGS. 23–26, the chairs being shown with their legs spring mounted in the dove-tail grooves of the facers.
Figure 29:
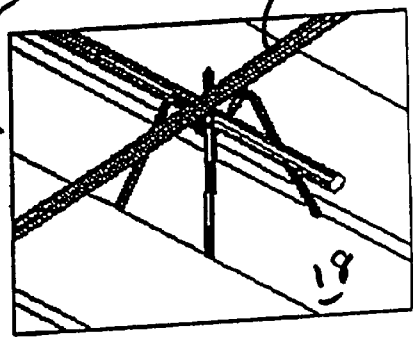
FIG. 29 is an enlarged perspective view showing a chair mounting a pair of right angularly arranged re-bars.

A support or "chair" for mounting elongated reinforcing members, commonly known as "re-bars", is illustrated in FIGS. 23–29 at 54. The chair 54 has four (4) legs 58, 58 and defines a pair of right angularly arranged upwardly open grooves 56, 56 at an upper portion thereof. The legs 58, 58 enter the grooves 18, 18 as best illustrated in FIGS. 27 and 29 and are preferably of flexible construction so as to bend inwardly and then snap into position. The reinforcing members or "re-bars" 61, 61 may then be mounted in the grooves 56, 56 as shown in FIGS. 27 through 29 prior to pouring the concrete so that both the chairs and the re-bars are thereafter embedded in the concrete.

FIGS. 30–35 illustrate another re-bar chair for supporting re-bars and for ease in locating the same.

Figure 41:
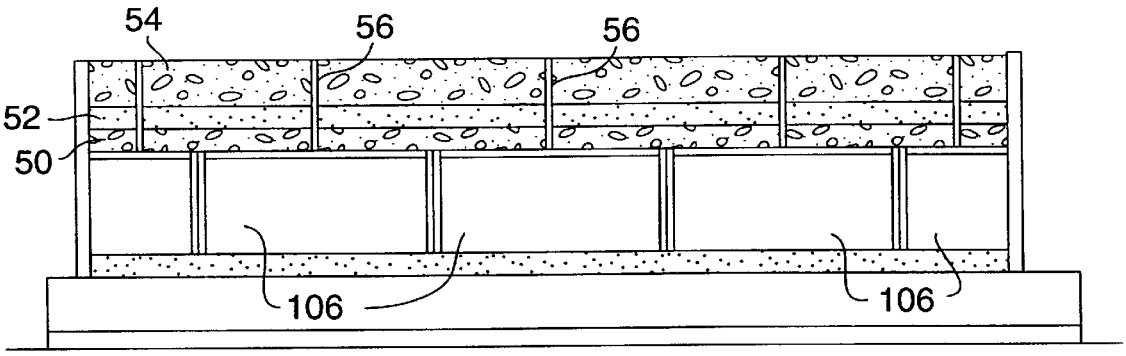
FIG. 41 is a perspective view of an insulated panel constructed in accordance with the method of the present invention.

In FIG. 41 an insulated panel is illustrated in cross-section and comprises a plurality of facers 106, 106 in planar arrangement as described above. A relatively thin layer of concrete 50 is then cast over the facers with a conventional insulating panel 52 disposed thereabove. Finally, a heavier layer of concrete 54 is cast atop the insulating panel with transverse connectors 56, 56 embedded in the concrete and preferably extending from the thin layer of concrete 50 through the insulating panel 52 and into the heavier layer of concrete 54.

Once a wall or other panel has been constructed and erected using the foregoing method, drainage becomes an important consideration. The sand used in the channels during pouring of the concrete may then be removed for example by power washing from the front of the wall. Once the sand has been removed, the "Y" or half "Y" channels of FIGS. 6 through 12 provide for drainage in both horizontal and vertical directions adjacent facers. Absent power washing or other treatment to remove the sand, nature will also work to achieve the same channel cleaning result. Wind and rain beating against the facers and the joints therebetween will dear the channels over time. That is, rain will penetrate rearwardly through the joints between facers and wash the sand from the "Y" or half "Y" channels 26 leaving voids for the flow of drainage water. As stated above, water trapped behind facers may loosen and even force facers off the wall in freezing conditions. Water trapped behind facers may also gradually migrate forwardly and evaporate on the front surfaces of the facers. Salts in the water will, however, result in an unsightly efflorescent effect on the front facer surfaces.

Figure 44:
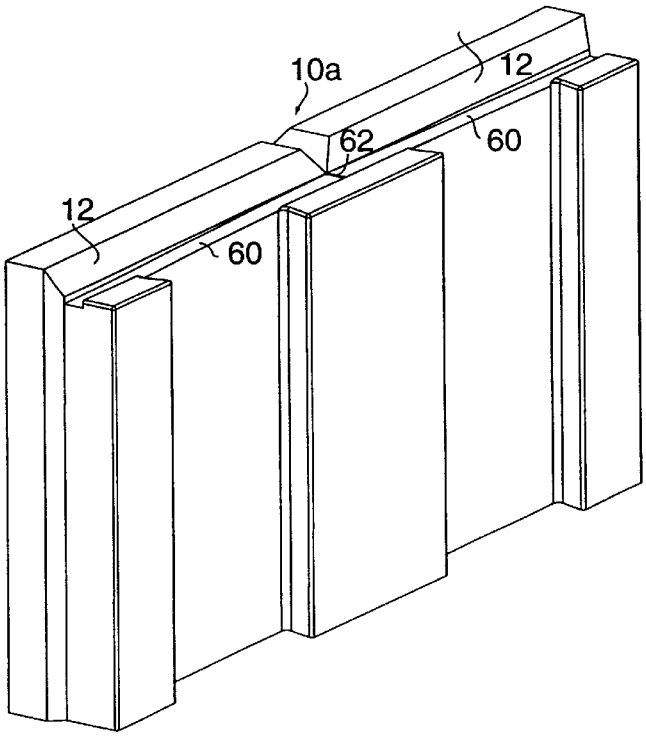
FIG. 44 is a perspective rear view of a facer provided with a drainage channel along its rear top edge portion.

In FIG. 44, a facer 10*a* is provided with an elongated auxiliary drainage groove 60 which is open at each end and resides in an upwardly open attitude near the top of the facer and adjacent the bevel or chamfer 12 formed along the top of the facer. At the center 62 of the groove 60 its bottom wall is elevated as shown and is inclined downwardly therefrom in opposite directions to enhance horizontal drainage flow toward the ends of the groove.

Figure 45:
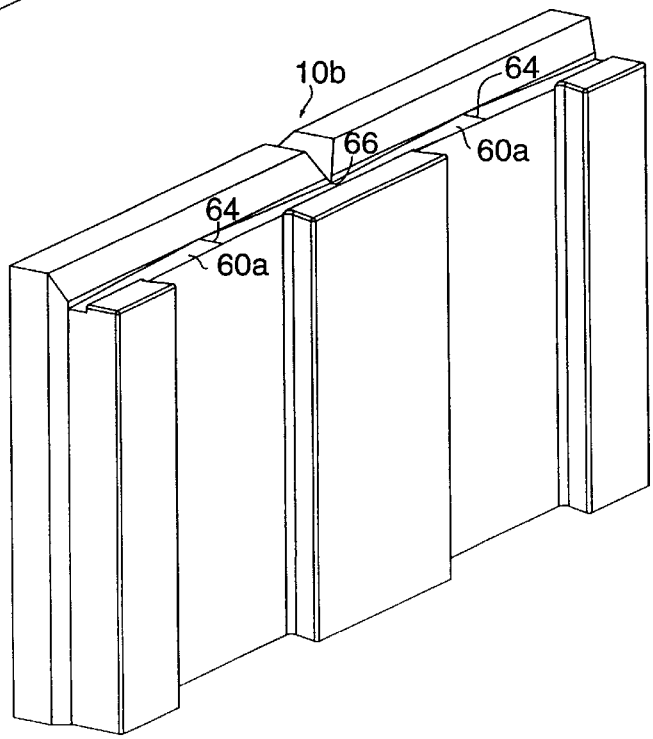
FIG. 45 is a view similar to FIG. 44 but with an improved drainage channel and a front to rear drainage notch, at a top edge portion thereof.

FIG. 45 illustrates a facer embodiment similar to the facer of FIG. 44 but provided with additional drainage features. Facer 106 has an auxiliary drainage groove 60*a* similar to the groove 60 of the facer 10*a* but with a low point and two spaced apart high points rather than one. High points 64, 64 are each approximately one fourth (¼) the length of the groove from adjacent groove ends and low point 66 is approximately at the center of the groove. Further, an upwardly open V-shaped notch 68 is provided at the center of the facer and communicates laterally with the groove and with the front surface of the facers. Thus, drainage water will flow both toward the ends and the center of the groove 60*a* and at the center it will drain forwardly through the notch for discharge down the front face of the facer. When facers are arranged in the usual "running bond" or staggered relationship, it will be noted that the V-shaped notch will align vertically with adjacent vertical bevels or chamfers for a pleasing effect aesthetically.

Figure 46:
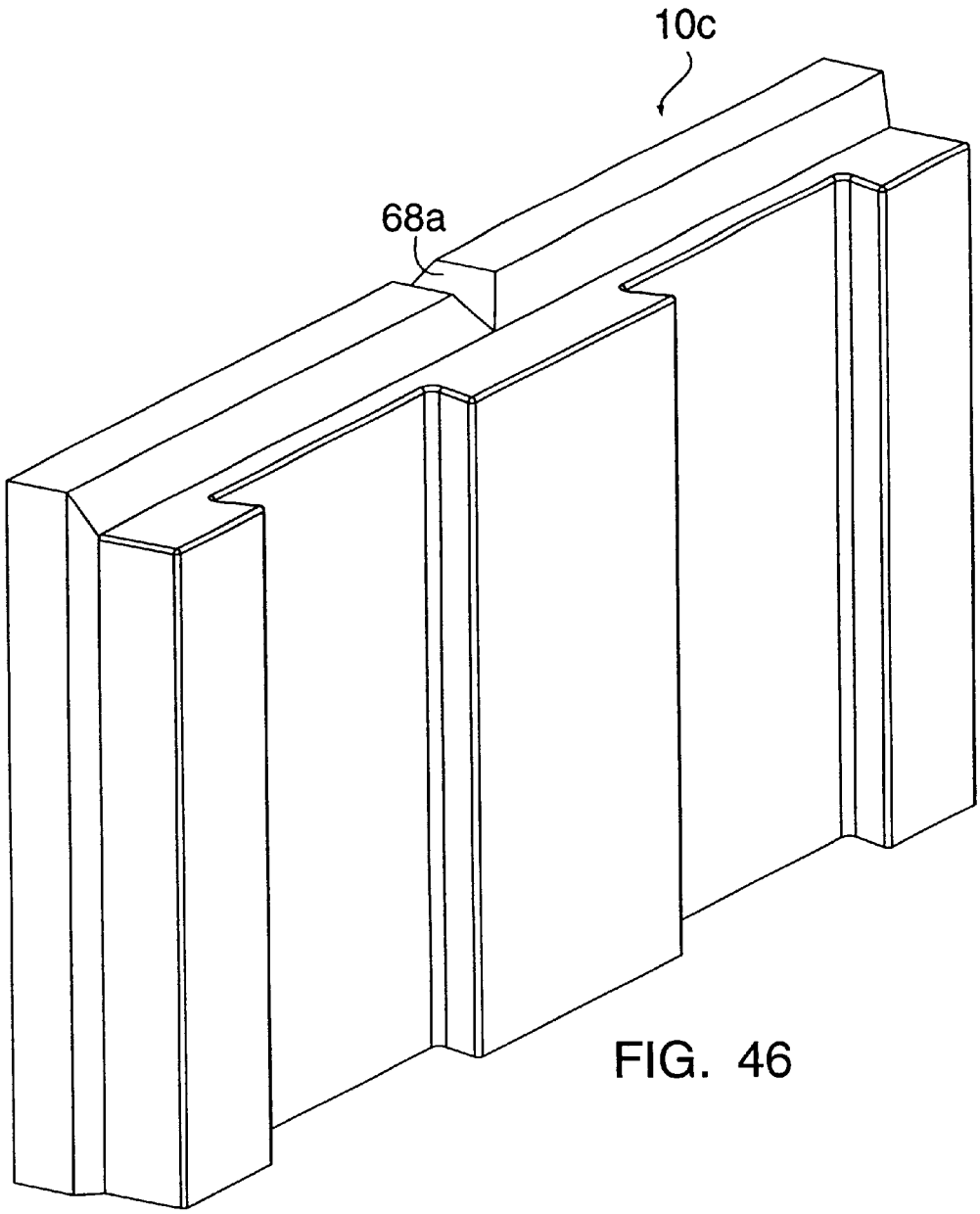
FIG. 46 is a view similar to FIG. 45 but showing only a front to rear drainage notch.

FIG. 46 illustrates a facer 10*c* provided with a central upwardly open notch 68*a* as in the case of the facer 10*b*. Operation is as described for the facer 10*b* with regard to the notch with unwanted water draining forwardly and down the front surface of the facer.

Figure 47:
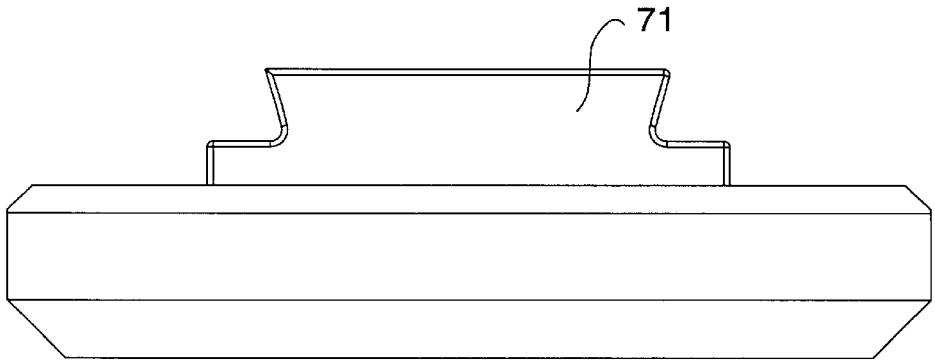
FIG. 47 is a top view of an end cap unit.

As will be apparent, exposed end surfaces of walls or other panels will also require aesthetic treatment when the walls or panels are moved to their final positions. Thus, an "end cap" facer 70 as illustrated in FIG. 47 may be required and may take the form of a facer approximately one-half (½) the length of a conventional facer described above. As shown, the "end cap" facer 70 has a single dove-tailed rib 71 on its rear surface so as to be secured in the concrete or other backing material in right angular arrangement with the front surface of the wall or panel, FIG. 48. A left hand wall 72 in FIG. 48 may be positioned slightly forwardly so as to provide for the end cap facer with its front surface in a common plane, or alternatively, one or the other of the walls may be notched as required to provide for a co-planer arrangement. The left hand wall 72 in FIG. 48 will exhibit a vertical seam as shown but the right hand wall 74 will have the overall appearance of a conventional wall with staggered joints. The end cap facer may be cast in position as shown with its dovetailed rib embedded in the concrete. Alternatively, the end cap facer may be provided without a rib and adhesively secured in position. A vertical gap appears at the corner as illustrated at 76 absent an overlap relationship of the end cap facer with the concrete of the right-hand wall 74.

Figure 48:
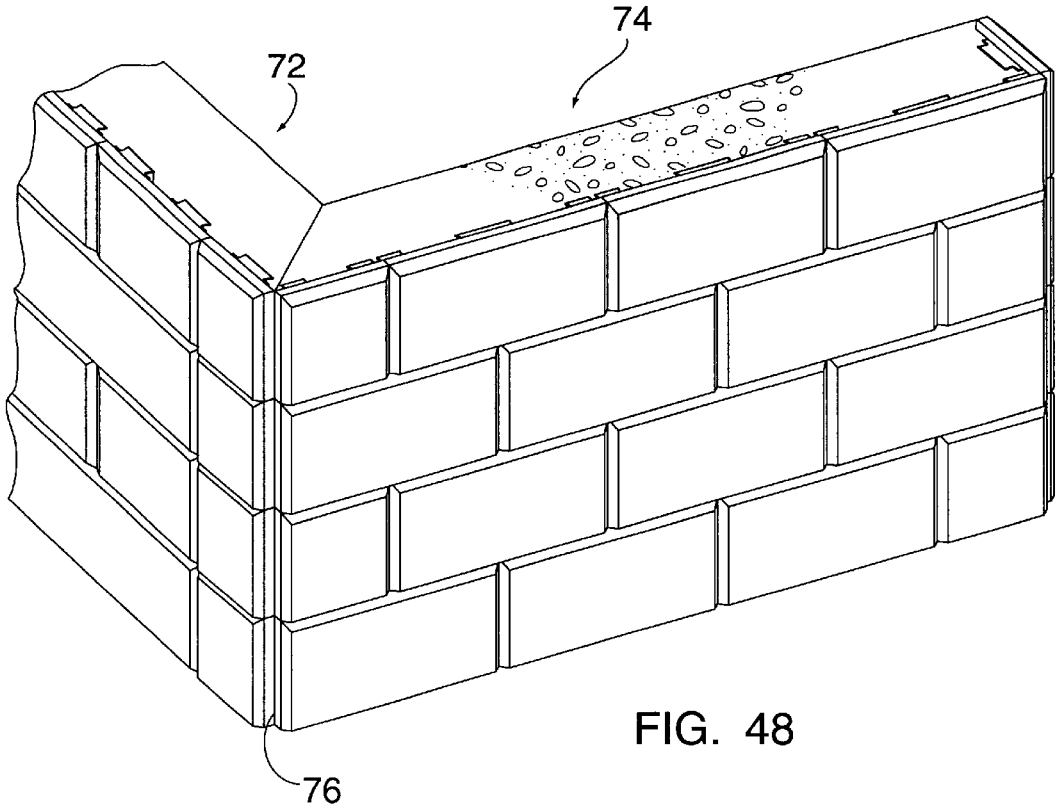
FIG. 48 is a perspective view of a portion of adjoining wall sections employing the end cap at a right hand 90° corner between the wall sections.
Figure 49:
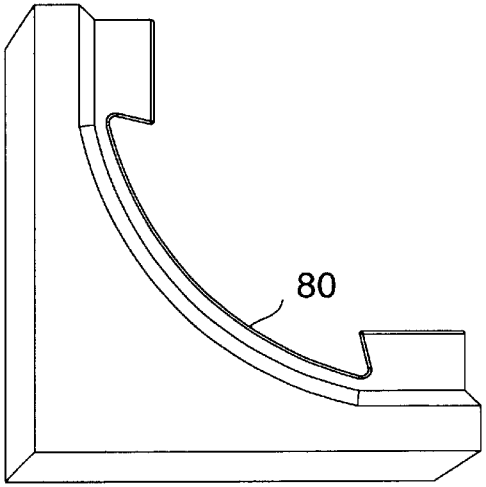
FIG. 49 is a right angular 90° corner unit.
Figure 50:
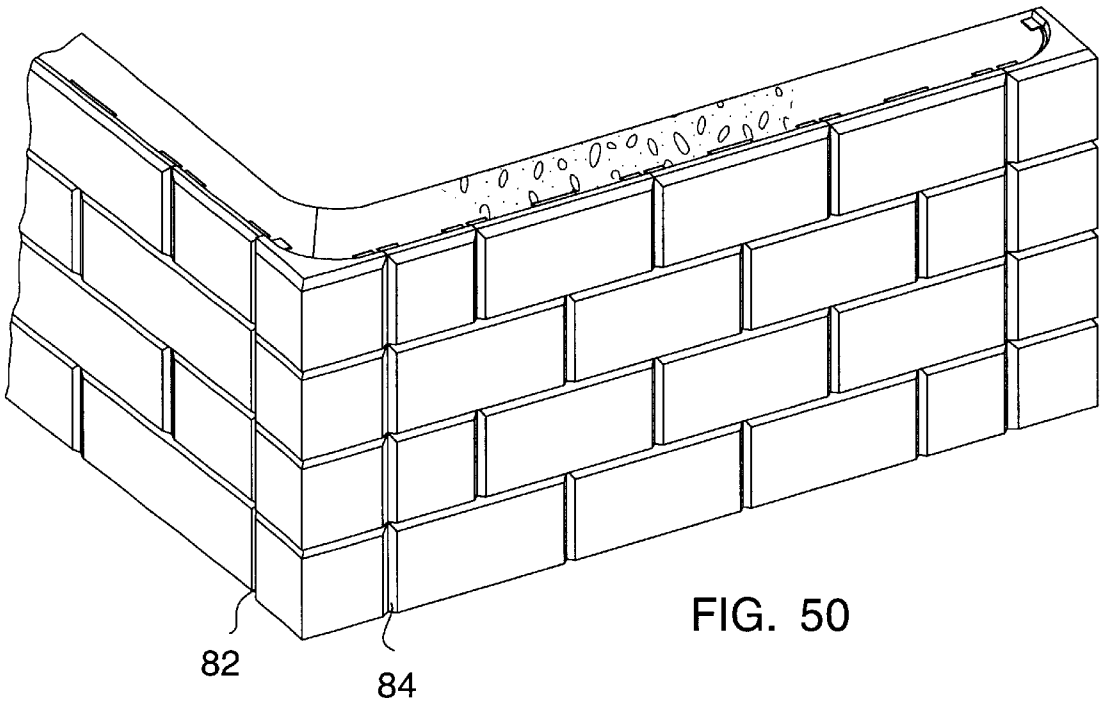
FIG. 50 is a perspective view of wall sections arranged at right angles and employing the corner section.

A unitary right angular corner facer is shown in FIGS. 49 and 50 and provides an aesthetically pleasing corner without the vertical gap of FIG. 48, see FIG. 50. Notching of the concrete or other backup material may be necessary depending on the thickness thereof. Secure mounting of the facer is provided for with structural ribs 76 and 78 adjacent opposite ends of the facer and an curved central portion 80 provides additional strength. As will be seen, vertical joints are provided adjacent each side of the corner as at 82 and 84 in FIG. 50.

Figure 51:
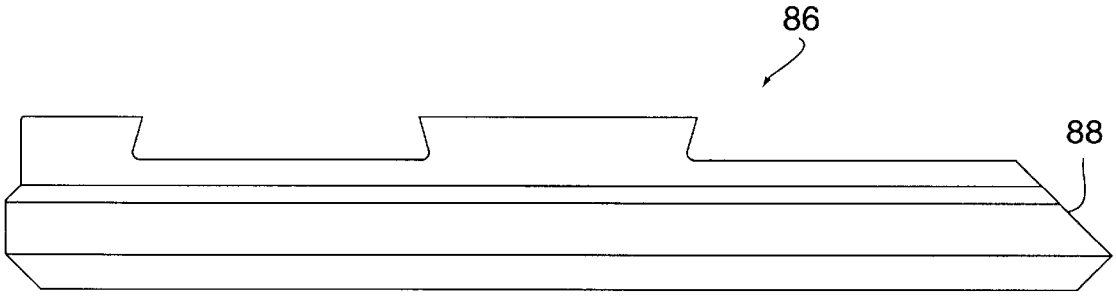
FIG. 51 is a corner facer unit employing a 45° mitered end surface.
Figure 52:
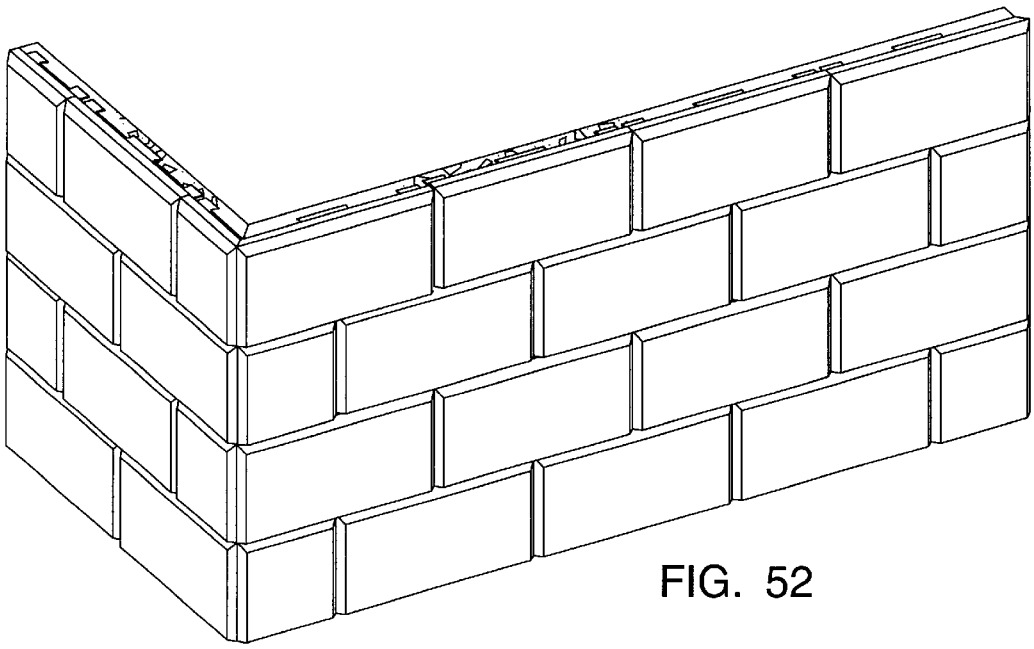
FIG. 52 is a perspective view of wall sections arranged at right angles and employing the corner unit of FIG. 51.

FIGS. 51 and 52 illustrate yet another method of corner treatment wherein facers such as 86 are provided at one end with a 45° mitered end surface 88. Obviously, a clean aesthetically pleasing corner results as in FIG. 52 when the concrete backing is also provided with 45° mitered end surfaces. Conventional running bond configurations can be provided on facer surfaces of both adjoining wall surfaces when full and half facers are each provided with mitered end surfaces.

Figure 53:
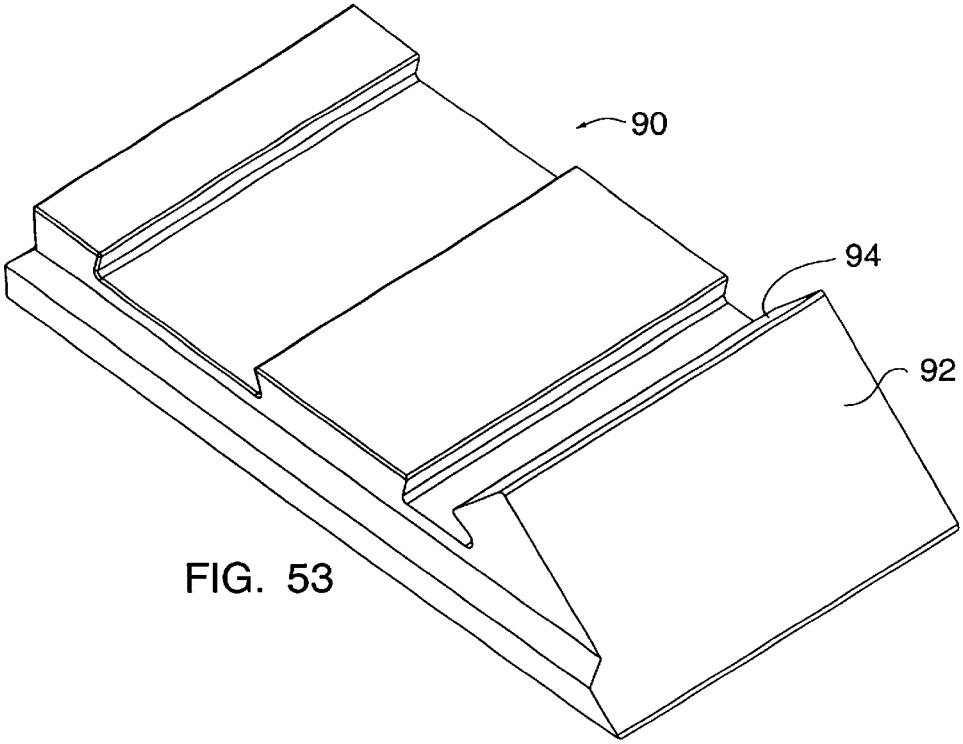
FIG. 53 is a rear perspective view of a facer unit having an enlarged 45° mitered end surface.
Figure 54:
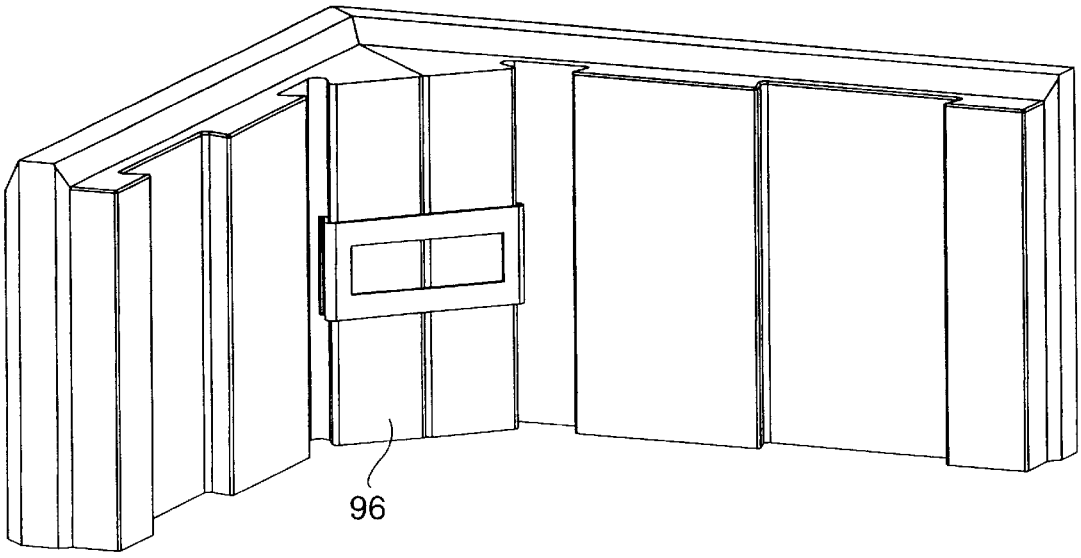
FIG. 54 is a rear view of a 90° corner section of a wall employing adjoining corner sections shown in FIG. 53.

Another version of a corner facer with a mitered end surface is indicated generally at 90 in FIG. 53 and has a 45° mitered end surface 92. In addition, one half of a dovetailed rib 94 is formed adjacent the mitered surface 92 and provides an enlarged mitered surface and also projects angularly rearwardly at 45° for cooperation with a similar rib 94 on an adjacent corner facer. The ribs 94, 94 together form a complete dovetailed rib 96 which projects angularly rearwardly as best shown in FIG. 54 and which may be employed with a complementary spring clip to secure two corner facers 90, 90 in assembly at right angles to each other. The facers may of course be clipped together and cast in place in method analogous to the units 80 in FIG. 49. Alternatively, the facers may be adhesively secured together at their mitered surfaces 92, 92.

Figure 55:
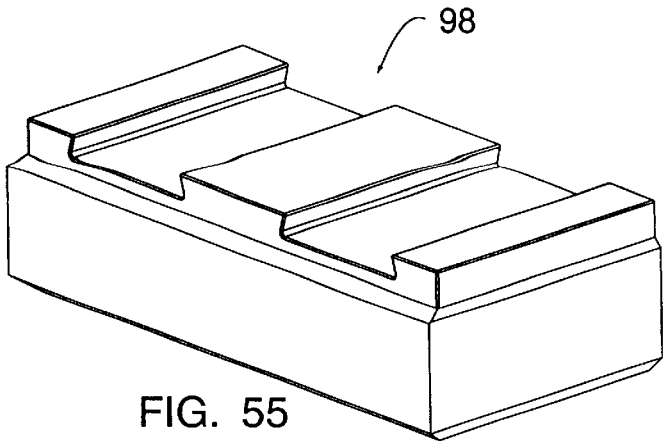
FIG. 55 is a rear perspective view of a heavy duty facer unit usable as a marginal member in windows and other wall openings.

FIG. 55 illustrates a facer 98 similar to the facers 10 et sequa but substantially thicker, approximately three (3) inches thick versus one (1) inch for the facers 10, 10. The facers 98, 98 may find a variety of uses as for example as marginal elements in door and window openings in walls employing conventional facers 10, 10.

Figure 56:
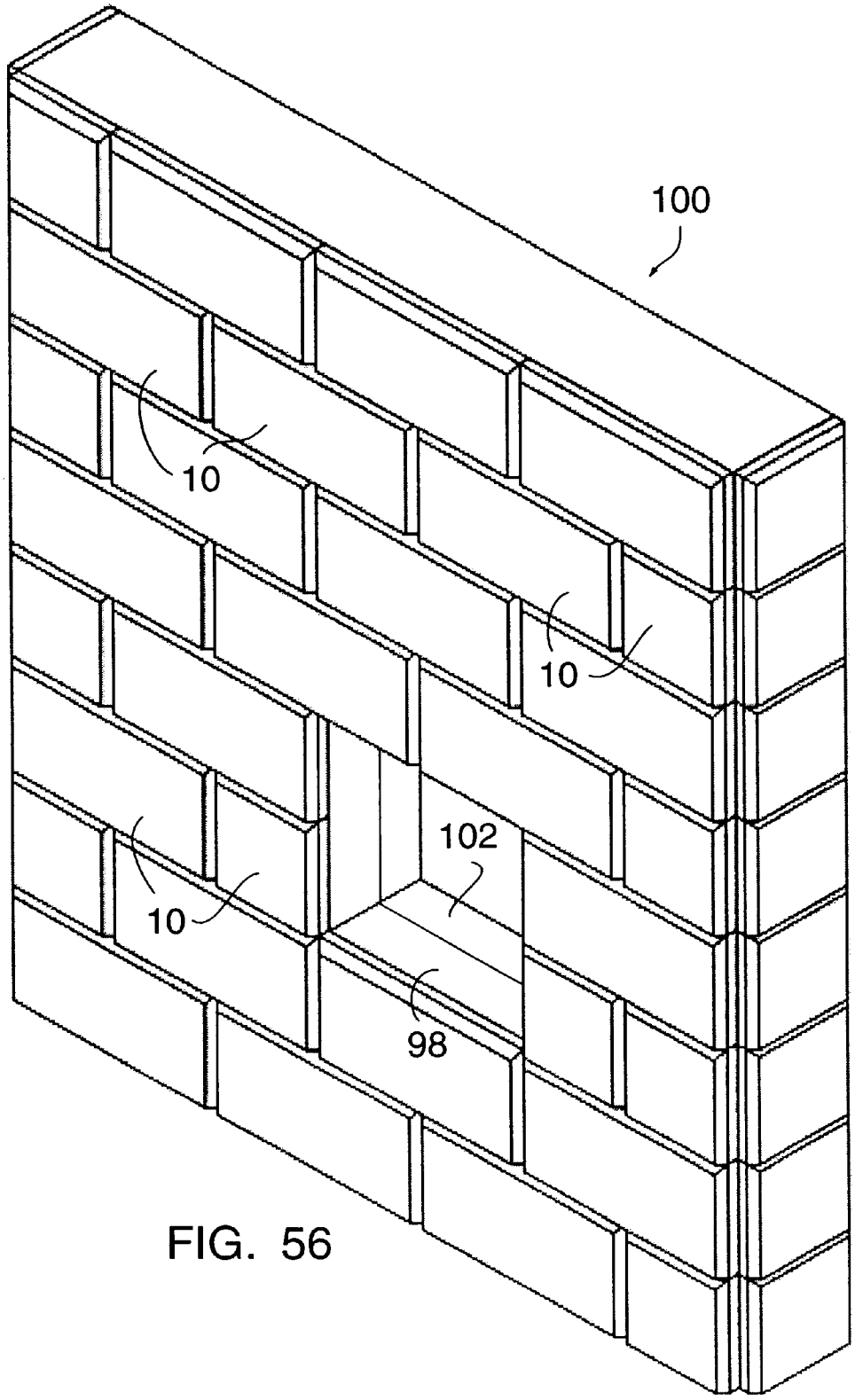
FIG. 56 is a perspective view of a wall with an opening employing a unit of FIG. 55.

In FIG. 56, a wall 100 defines a window opening 102 with a facer 98 employed as a sill member. Although not so illustrated, facers 98, 98 may also be employed as lintel and jamb members for improved appearance, resulting from the additional "set back" of the concrete backing material when viewed from the front. Corner units such as the FIG. 49 and FIG. 54 units may also be employed in forming window and door jambs for improved appearance.

Figure 57:
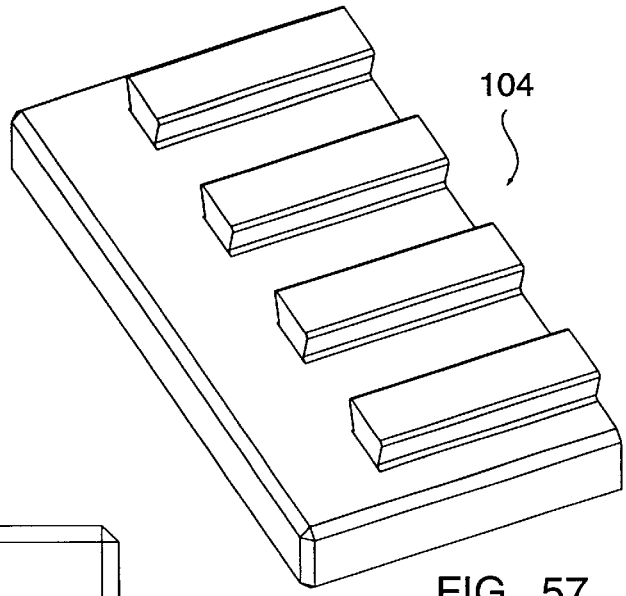
FIG. 57 is a perspective of a cap unit.
Figure 58:
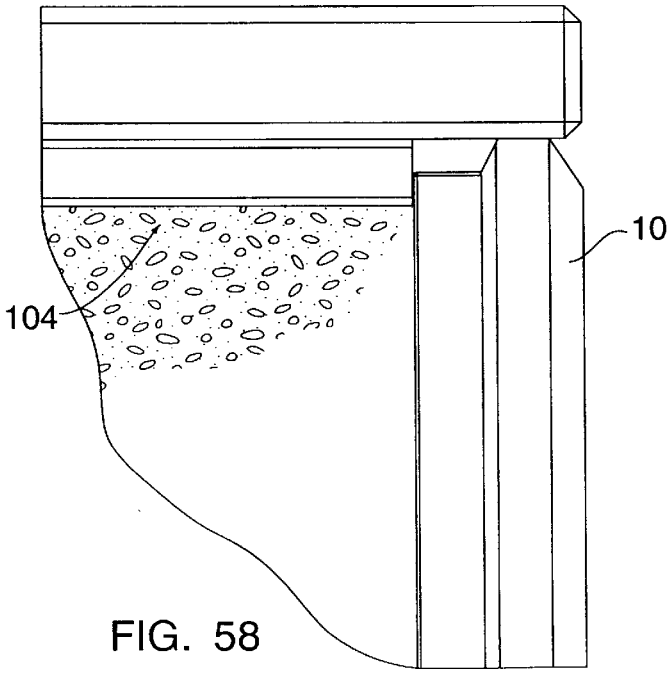
FIG. 58 is a side view of a cap unit in assembly with a facer unit and associated concrete backing.

A "cap block" 104 is illustrated in FIG. 57 and may find application as its name implies to form a cap along the top of a wall, FIG. 58. Facers 10, 10 engage and support forward end portions of the blocks 104, 104 when the wall has been erected and rear portions thereof are supported by the concrete as shown with a series of small parallel dovetailed ribs embedded in the concrete. It should also be observed that the block 104 shown in FIG. 58 can be employed, for example, as a windowsill lintel or jamb members with the window or door opening defined thereby.

As will be apparent from the foregoing, a method has been provided for forming a composite panel of groutless construction in an extremely simple and yet highly efficient manner. The method may obviously be employed at economic advantage in the construction of composite tilt-up walls, precast and other panels having a wide variety of facial characteristics with a minimum of manual labor and an aesthetically pleasing and/or functionally improved end result.

What is claimed is:

1. A method of forming a composite panel with a facade comprising a planar arrangement of thin facers on a body of structural backing material; said method comprising the steps of providing a substantially flat casting bed, providing a plurality of facers each having a substantially rectangular configuration with recesses along at least one rear end wall corner and along at least one rear side wall corner, arranging the plurality of individual facers in abutting relationship atop the casting bed and in a selected geometrical pattern in a face down planar configuration so that recesses on the facers open rearwardly and cooperatively define narrow elongated channels at joints between contiguous facers, depositing a sealant in the channels between facers to prevent the structural backing material from penetrating the joints between during casting and defacing the front surfaces thereof, casting structural material behind the facers to conform and adher to the rear surfaces thereof and form a composite panel.

2. A method of forming a composite panel as set forth in claim 1 wherein each recess takes the form of a chamfer with a flat angularly inclined surface extending between adjacent side, end and rear facer surfaces.

3. A method of forming a composite panel as set forth in claim 1 wherein fine particulate material is used as a sealant.

4. A method of forming a composite panel as set forth in claim 3 wherein the fine particulate material is sand.

5. A method of forming a composite panel as set forth in claim 4 wherein the sand is deposited on the rear surfaces of the facers and swept into the sealant channels while the rear surfaces of the facers are swept clean.

6. A method of forming a composite panel as set forth in claim 1 wherein the sealant takes the form of a hardenable liquid material deposited in the sealant channels and then allowed to at least partially harden so as to prevent the structural material from penetrating the joints between the facers during casting.

7. A method of forming a composite panel as set forth in claim 1 wherein a fine particulate material is employed in providing a deformable casting bed.

8. A method of forming a composite panel as set forth in claim 7 wherein the fine particulate material is sand.

9. A method of forming a composite panel as set forth in claim 1 wherein a compressible foam plastic material is employed in providing the casting bed.

10. A method of forming a composite panel as set forth in claim 9 wherein the foam plastic material is provided in the form of a corrugated mat to better absorb irregularities in the facers and support the same in a common plane.

11. A method of forming a composite panel as set forth in claim 1 induding providing a plurality of complementary clips and ribs on the backs of facers, and installing the dips in interconnecting relationship with the ribs on contiguous facers to force the facers into firm engagement and help prevent leakage therebetween during casting of the structural material.

12. A method of forming a composite panel as set forth in claim 11 where some of the clips are installed in interconnecting relationship on ribs of contiguous facers arranged in end-to-end relationship and others are installed on ribs of contiguous facers arranged in side-by-side relationship.

13. A method of forming a composite panel as set forth in claim 12 wherein dove-tailed ribs are provided and wherein the spring clips are provided each with a generally dove-tailed configuration in cross-section and with short opposing side legs defining an opening for receiving a dove-tailed rib, the legs of each clip being inwardly inclined toward the mouth of the clip opening, and wherein the clips are snapped into interconnecting positions on the ribs in movement of the clips relative to the ribs, the clips engaging the ribs and being thus mounted in embracing relationship therewith.

14. A method of forming a composite panel as set forth in claim 13 wherein the clips are provided with vertical through openings for entry of the structural material during casting.

15. A method of forming a composite panel as set forth in claim 14 including the step of spreading and engaging the legs of each clip with a rib and then releasing and thus connecting the same in embracing relationship with the rib.

16. A method of forming a composite panel as set forth in claim 15 and including the steps of providing a tool for conveniently manually spreading and releasing the legs of a clip and thus efficiently snapping the clips into embracing positions on the ribs.

17. A method of forming a composite panel as set forth in claim 1 wherein a retarder is applied to the front surfaces of the facers.

18. A method of forming a composite panel as set forth in claim 1 wherein an "anti bonding agent" is applied to the front surfaces of the facers.

19. A method of forming a composite panel as set forth in claim 1 wherein Self Compacting Concrete is employed as structural backing material.

20. A method of forming a composite panel as set forth in claim 1 wherein the facers are provided with integral rearwardly and upwardly projecting connecting means which are embedded in the structural backing material during casting to provide for enhanced structural integrity of the panel.

21. A method of forming a composite panel as set forth in claim 20 wherein the connecting means take the form of a series of ribs integral with the bodies of the facers.

22. A method of forming a composite panel as set forth in claim 21 wherein the ribs on the facers take a generally dove-tailed configuration viewed in cross-section with complementary generally dove-tailed spaces therebetween for enhancing the strength of the connection with the structural backing material.

23. A method of forming a composite panel as set forth in claim 22 wherein a plurality of anchors are provided and installed each with a flexible base portion adapted to snap into engagement with at least one rib and each with a body portion projecting therefrom so as to be embedded in structural material during casting.

24. A method of forming a composite panel as set forth in claim 23 wherein the anchors each have base portions adapted to snap into engagement in dove-tailed grooves between adjacent ribs.

25. A method of forming a composite panel as set forth in claim 22 wherein a plurality of supports for reinforcing members are provided and mounted on the backs of the facers.

26. A method of forming a composite panel as set forth in claim 23 wherein the supports are spring mounted on one or more ribs.

27. A method of forming a composite panel as set forth in claim 22 wherein the supports have base portions adapted to slide in an endwise direction into the dove-tailed inter-rib grooves.

28. A method of forming a composite panel as set forth in claim 22 wherein each support takes a chair-like configuration with an upper reinforcing member mounting portion and depending flexible legs adapted to be compressed inwardly toward each other with lower end portions thereof engaging adjacent ribs.

29. A method of forming a composite panel as set forth in claim 28 wherein each support mounting portion has at least one open groove for receiving and supporting a portion of a reinforcing bar.

30. A method of forming a composite panel as set forth in claim 29 wherein each support mounting portion has two right angularly arranged open grooves for receiving and supporting portions of a reinforcing bar.

31. A method of forming a composite panel as set forth in claim 29 wherein each support mounting portion has two pairs of right angularly arranged open grooves for receiving and supporting portions of a reinforcing bar, each pair of grooves comprising of at least three (3) aligned grooves.

32. A method of forming a composite panel as set forth in claim 29 wherein each support mounting portion has two pairs of right angularly arranged open grooves for receiving and supporting portions of a reinforcing bar, one pair of grooves comprising three (3) aligned grooves and the other comprising five (5) aligned grooves.

33. A method of forming a composite panel as set forth in claim 29, wherein the structural material takes the form of concrete.

34. A method of forming a composite tilt-up wall with a facade comprising a planar arrangement of thin decorative rectangular facers on a body of concrete structural backing material; said method comprising the steps of providing a flat substantially horizontal casting bed, providing a plurality of facers each with chamfers along at least the corners between end and rear walls and at least one side and rear wall, arranging the individual facers in abutting relationship atop the casting bed and in a selected geometric pattern in a face-down down planar configuration so that the chamfers on the facers open upwardly and define narrow elongated sealant channels between contiguous facers, depositing sand on the rear surfaces of the facers and in the channels therebetween, cleaning the sand from the rear surfaces of the facers, casting concrete atop the facers to adhere to the rear surfaces thereof and to form a composite wall, and tilting the wall to an upright position.

35. A method of forming a composite panel as set forth in claim 1 wherein an insulating panel is embedded within the structural backing material with a first portion of the latter between the panel and the facers and a second portion on an opposite side of the panel.

36. A method of forming a composite panel as set forth in claim 35 wherein a plurality of connectors are embedded in the insulating panel and extend in opposite directions into both the first and second portions of the structural backing material.

37. A method of forming a composite panel as set forth in claim 1 wherein drainage channels are provided along side walls of the facers which are to become top walls when the wall or panel is erected, said channels being open upwardly when the wall is in its erected attitude and being open at opposite ends and in drainage communication with the aforesaid channels between end and rear walls, said latter channels extending vertically when the wall or panel is erected.

38. A method of forming a composite panel as set forth in claim 37 wherein said drainage channel is provided with a bottom surface which is elevated substantially at its mid point and is inclined downwardly therefrom toward opposite ends of the channel.

39. A method of forming a composite panel as set forth in claim 38 wherein a generally V-shaped drainage notch is provided approximately at a mid-point along one side of each facer and is open from rear to front to prevent entrapment of water behind the facer.

40. A method of forming a composite panel as set forth in claim 39 wherein the V-shaped drainage notches are located to be at the top of their respective facers in an erected wall, and wherein elongated drainage channels are provided rearwardly along the side edges of the facers in communication with the drainage notches.

41. A method of forming a composite panel as set forth in claim 40 wherein said drainage channels are open at opposite ends and inclined slightly upwardly from the ends for approximately one fourth (¼) their length, the channels thereafter being inclined slightly downwardly to their mid-points for drainage forwardly through the V-notch at the mid-point.

42. A method of forming a composite panel as set forth in claim 1 wherein end caps are provided for the panels in the form of units having approximately the same width as the facers but lengths approximately the thickness of the backing material, the caps also having at least one rib projecting from its rear surface which is embedded in the backing material when the cap is arranged at right angles to the facers at the end of a panel.

43. A method of forming a composite panel as set forth in claim 1 wherein corner units are provided for the panels in the form of 90° angularly related numbers each having at least one rearwardly disposed rib adapted to be embedded in backing material during casting.

44. A method of forming a composite panel as set forth in claim 43 wherein said 90° angularly related corner units are enlarged as marginal units in window and door openings.

45. A method of forming a composite panel as set forth in claim 1 wherein end units are provided in the form of facers having a 45° mitered end surface at one end, said end surfaces being exposed at ends of the panel to engage a similarly configured end surface on an adjacent panel arranged at right angles to form a 90° corner between engaging facers and panels.

46. A method of forming a composite panel as set forth in claim 45 wherein the end units have portions at their mitered ends which project rearwardly to provide substantially enlarged mitered surfaces for engagement with the like surfaces of facers at 90° corners.

47. A method of forming a composite panel as set forth in claim 46 wherein engaging mitered surfaces of facers at 90° corners are bonded together adhesively.

48. A method of forming a composite panel as set forth in claim 46 wherein said rearwardly projecting portions of adjacent facers at 90° corners cooperatively form dove-tailed ribs exposed rearwardly at the corner, and wherein complementary generally U-shaped connecting spring clips are provided and are engaged with the dove-tailed ribs to secure the adjacent facers together.

49. A method of forming a composite panel as set forth in claim 1 wherein an opening is provided in the panel, and wherein at least one of the facers is provided with a thickness approximately three times that of the remaining facers, said facer being arranged along at least one edge of the opening for aesthetic improvement.

50. A method of forming a composite panel as set forth in claim 1 wherein cap units are provided and are arranged along the margin of an opening in the panel edge when the panel is erected, the units having ribs on near surfaces which are foreshortened to provide a space for receiving portions of front facers with the units arranged at right angles to the front facers and with their ribs embedded in the backing material.

* * * * *